US011065674B2

(12) United States Patent
Kawai et al.

(10) Patent No.: US 11,065,674 B2
(45) Date of Patent: Jul. 20, 2021

(54) FASTENING TOOL

(71) Applicant: MAKITA CORPORATION, Anjo (JP)

(72) Inventors: Yuki Kawai, Anjo (JP); Michisada Yabuguchi, Anjo (JP); Hiroki Ikuta, Anjo (JP); Toshihito Yabunaka, Anjo (JP)

(73) Assignee: MAKITA CORPORATION, Anjo (JP)

( * ) Notice: Subject to any disclaimer, the term of this patent is extended or adjusted under 35 U.S.C. 154(b) by 183 days.

(21) Appl. No.: 16/465,130

(22) PCT Filed: Nov. 24, 2017

(86) PCT No.: PCT/JP2017/042306
§ 371 (c)(1),
(2) Date: May 29, 2019

(87) PCT Pub. No.: WO2018/101181
PCT Pub. Date: Jun. 7, 2018

(65) Prior Publication Data

US 2019/0283111 A1 Sep. 19, 2019

(30) Foreign Application Priority Data

Nov. 30, 2016 (JP) ..... JP2016-233636
Jun. 19, 2017 (JP) ..... JP2017-119968

(51) Int. Cl.
*B21J 15/26* (2006.01)
*B21J 15/10* (2006.01)
(Continued)

(52) U.S. Cl.
CPC ..... *B21J 15/26* (2013.01); *B21J 15/105* (2013.01)

(58) Field of Classification Search
CPC . B21J 15/26; B21J 15/28; B21J 15/022; B21J 15/043
See application file for complete search history.

(56) References Cited

U.S. PATENT DOCUMENTS 5,655,289 A * 8/1997 Wille ..... B21J 15/26 29/243.53
6,145,360 A * 11/2000 Honsel ..... B21J 15/26 72/19.8
(Continued)

FOREIGN PATENT DOCUMENTS

EP 0 653 259 A1 5/1995
EP 0 953 388 A2 11/1999
(Continued)

OTHER PUBLICATIONS

Feb. 26, 2020 Office Action issued in Chinese Patent Application No. 201780074034.7.
(Continued)

*Primary Examiner* — Bayan Salone
(74) *Attorney, Agent, or Firm* — Oliff PLC

(57) ABSTRACT

A fastening tool includes a fastener-abutment part, a pin-gripping part, a motor, a driving mechanism, an input-accepting part and a motor-control part. The fastener-abutment part is configured to abut on a cylindrical part of a fastener. The pin-gripping part is configured to grip a portion of a pin of the fastener. The driving mechanism is configured to be driven by power of the motor to move the pin-gripping part rearward along a driving axis relative to the fastener-abutment part, thereby fastening a workpiece via the fastener. The input-accepting part is configured to accept setting information for a control condition of the motor inputted via an operation part configured to be externally operated by a user. The motor-control part is configured to control operation of the driving mechanism by controlling driving of the motor according to the control condition based on the setting information accepted by the input-accepting part.

14 Claims, 9 Drawing Sheets

(51) Int. Cl.

| | |
|---|---|
| ***B21J 15/28*** | (2006.01) |
| ***B21J 15/02*** | (2006.01) |
| ***B21J 15/04*** | (2006.01) |

(56) References Cited

U.S. PATENT DOCUMENTS

| | | | |
|---|---|---|---|
| 2015/0040373 | A1 | 2/2015 | Chen |
| 2015/0074964 | A1 | 3/2015 | Masugata |
| 2016/0114383 | A1 | 4/2016 | Honsel |

FOREIGN PATENT DOCUMENTS

| | | | |
|---|---|---|---|
| EP | 2 985 094 | A1 | 2/2016 |
| JP | H07-164092 | A | 6/1995 |
| JP | 2004-508932 | A | 3/2004 |
| JP | 2013-248643 | A | 12/2013 |
| WO | 02/23056 | A1 | 3/2002 |
| WO | 2014/195189 | A1 | 12/2014 |

OTHER PUBLICATIONS

Jun. 9, 2020 Extended Search Report issued in European Patent Application No. 17877102.8.
Aug. 4, 2020 Office Action issued in Japanese Patent Application No. 2016-233636.
Aug. 25, 2020 Office Action issued in Japanese Patent Application No. 2017-119968.
Jun. 4, 2019 International Preliminary Report on Patentability issued in International Patent Application No. PCT/JP2017/042306.
Jan. 16, 2018 International Search Report issued in International Patent Application No. PCT/JP2017/042306.

* cited by examiner

FASTENING TOOL

TECHNICAL FIELD

The present invention relates to a fastening tool which is configured to fasten a workpiece via a fastener.

BACKGROUND ART

A fastening tool is known which is configured to fasten workpieces via a fastener, which has a pin and a cylindrical part. As the fastener, a so-called multi-piece swage type fastener or a so-called blind rivet may be used. The multi-piece swage type fastener includes a pin and a cylindrical part (also referred to as a collar) which are formed separately from each other. The blind rivet includes a pin (also referred to as a mandrel) and a cylindrical part (also referred to as a rivet body or sleeve) which are formed integrally with each other.

For example, Japanese laid-open patent publication No. 2013-248643 discloses a fastening tool for blind rivets. In this fastening tool, when a motor is driven, a pulling head is moved from a front end home position so that a shaft part of a pin is pulled rearward. By this pulling, the pin is torn off and a cylindrical part is deformed, so that workpieces are fastened. The pulling head is moved to a rearmost position located rearward of a position at which the pin is torn off, and thereafter returned forward to the home position.

SUMMARY OF THE INVENTION

Problem to be Solved by the Invention

In the above-described fastening tool, a control circuit controls the position of the pulling head by controlling driving of the motor based on the counted number of revolutions of the motor. In this position control, the control conditions of the motor are always fixed. Therefore, if an positional relationship between component parts changes, for example, due to wear of component parts of a mechanism for pulling the pin, the pulling head may not be able to grip the pin with an appropriate gripping force, even if returned to a specified home position.

Accordingly, it is an object of the present invention to provide a technique which may realize appropriate control according to working conditions of a fastening tool which is configured to fasten a workpiece via a fastener.

Embodiment to Solve the Problem

According to one aspect of the invention, a fastening tool is provided which is configured to fasten a workpiece via a fastener, which has a pin and a cylindrical part. The fastening tool includes a fastener-abutment part, a pin-gripping part, a motor, a driving mechanism, an input-accepting part and a motor-control part.

The fastener-abutment part is configured to abut on the cylindrical part of the fastener. The pin-gripping part is disposed to be movable along a driving axis relative to the fastener-abutment part. The driving axis extends in a front-rear direction of the fastening tool. Further, the pin-gripping part is configured to grip a position of the pin. The driving mechanism is configured to be driven by power of the motor to move the pin-gripping part rearward along the driving axis relative to the fastener-abutment part, thereby fastening the workpiece via the fastener. The input-accepting part is configured to accept setting information for a control condition of the motor which is inputted via an operation part configured to be externally operated by a user. The motor-control part is configured to control operation of the driving mechanism by controlling driving of the motor according to the control condition based on the setting information accepted by the input-accepting part.

According to the present aspect, the motor-control part is capable of controlling driving of the motor and thus the operation of the driving mechanism, not according to a fixed control condition, but to a control condition which may be different according to the setting information accepted by the input-accepting part. Further, a user can input appropriate setting information according to the working conditions of the fastening tool via the operation part. Therefore, according to the present aspect, appropriate control can be realized according to the working conditions of the fastening tool.

The fastener which may be used in the fastening tool according to the present aspect may include a so-called blind rivet and a multi-piece swage type fastener.

In a blind rivet, the pin and the cylindrical part (also referred to as a rivet body or sleeve) are integrally formed with each other. The blind rivet is a fastener of the type which is configured to clamp a workpiece between both end portions of the cylindrical part (specifically, a flange provided on one end portion of the cylindrical part and the other end portion of the cylindrical part which is deformed to radially expand when the pin is pulled in an axial direction). In a multi-piece swage type fastener, the pin and the cylindrical part (also referred to as a collar) are originally formed separately from each other. The multi-piece swage type fastener is a fastener of the type which is configured to clamp a workpiece between a head of the pin and the cylindrical part swaged to a shaft part of the pin.

In the blind rivet, a portion of the pin (also referred to as a pintail or mandrel) is finally torn off and separated at a small-diameter part for breakage. On the other hand, the multi-piece swage type fastener includes a fastener of the type in which the pintail is torn off like in the blind rivet, and a fastener of the type in which the shaft part is retained as it is without being torn off. In use of the fastener of either type, the pin is moved relative to the cylindrical part by a fastening mechanism so that a workpiece is fastened with the fastener.

The structure of the fastener-abutment part is not particularly limited as long as the fastener-abutment part is configured to abut on the cylindrical part of the fastener. For example, in a case where the blind rivet is used, the fastener-abutment part may be configured to abut on and press the flange of the cylindrical part (the rivet body or sleeve). Further, for example, in a case where the multi-piece swage type fastener is used, the fastener-abutment part may be configured to abut on and engage with the cylindrical part (collar) to thereby deform the cylindrical part by a swaging force. In the both cases, any known structure can be employed. Typically, the fastener-abutment part may be configured as a cylindrical body. The fastener-abutment part may be held by a housing by being connected to the housing directly or via a different member. Further, the fastener-abutment part may be configured to be detachable from the housing.

The structure of the pin-gripping part is not particularly limited as long as the pin-gripping part is disposed to be movable along the driving axis in the front-rear direction relative to the fastener-abutment part and configured to grip a portion of the pin. For example, in a case where either the blind rivet or the multi-piece swage type fastener is used, any known structure may be employed which is provided with a jaw having a plurality of claws to grip a portion of a pin (specifically, a shaft part of the pin) and a holding part (also referred to as a jaw case) for the jaw. Typically, the pin-gripping part may be disposed coaxially with the cylindrical fastener-abutment part within the fastener-abutment part. Further, the pin-gripping part may be configured to be detachable from the housing.

As the driving mechanism, any structure can be employed which can move the pin-gripping part along the driving axis relative to the fastener-abutment part. For example, as the driving mechanism, a feed-screw mechanism and a ball-screw mechanism may be suitably employed. Each of the feed-screw mechanism and the ball-screw mechanism is a mechanism capable of converting rotation into linear motion. In the feed-screw mechanism, a female thread part formed in an inner peripheral surface of a cylindrical rotary member and a male thread part formed in an outer peripheral surface of a movable member inserted through the rotary member are engaged (threadedly engaged) directly with each other. In the ball-screw mechanism, the rotary member and the movable member are engaged with each other via a number of balls which are rollably disposed within a spiral track defined between the inner peripheral surface of the cylindrical rotary member and the outer peripheral surface of the movable member inserted through the rotary member. Typically, the rotary member may be held by the housing via a bearing, while the movable member may be directly or indirectly connected to the pin-gripping part. However, it may be configured such that the movable member is rotatably supported by the housing, while the rotary member is directly or indirectly connected to the pin-gripping part.

Alternatively, for example, a rack-and-pinion mechanism may be employed.

The operation part may be provided to the fastening tool, or configured as an external device with which the fastening tool can communicate by wire or wireless means. In other words, the setting information may be inputted into the input-accepting part from the operation part provided on the fastening tool, or the setting information transmitted from the operation part configured as the external device may be inputted into the input-accepting part. The "setting information for the control condition of the motor" used herein may include information relating to setting of a timing of starting or stopping driving of the motor, and information relating to setting of an operation mode. Furthermore, the setting information for the control condition of the motor may also include information for changing (adjusting) a value for controlling the motor which is set beforehand.

"Controlling driving of the motor" by the motor-control part may refer to controlling start and stop of driving of the motor, for example, by controlling energization to the motor. Further, the motor-control part may also be capable of controlling the rotation speed of the motor.

According to one aspect of the present invention, the fastening tool may be configured to use, as the fastener, a shaft-retaining multi-piece swage type fastener, in which the pin and the cylindrical part are formed separately from each other. The pin may include a shaft part and a head. The shaft part may have no small-diameter part for breakage, and the head may be formed on one end of the shaft part. The cylindrical part may have a hollow cylindrical shape engageable with the shaft part of the pin. The input-accepting part may be configured to accept, as the setting information, setting information for a threshold of a pulling force of the pin-gripping part pulling the shaft part. The motor-control part may be configured to control operation of the driving mechanism to move the pin-gripping part gripping the shaft part rearward relative to the fastener-abutment part such that the fastener-abutment part presses the cylindrical part engaged with the shaft part in an axial direction and radially inward, thereby swaging the cylindrical part onto the shaft part and thus fastening the workpiece between the head and the cylindrical part. Further, the motor-control part may be configured to control operation of the driving mechanism to terminate a rearward relative movement of the pin-gripping part when the pulling force of the pin-gripping part pulling the shaft part exceeds the threshold. The motor-control part may be further configured to move forward the pin-gripping part gripping the shaft part with the cylindrical part swaged thereto, relative to the fastener-abutment part.

In operation of fastening a workpiece by using the shaft-retaining multi-piece swage type fastener, after moving the pin-gripping part rearward and swaging the cylindrical part onto the shaft part of the pin, the driving mechanism may move forward the pin-gripping part gripping the shaft part with the cylindrical part swaged thereto. Therefore, the pulling force of the pin-gripping part pulling the shaft part may need to be set to an appropriate pulling force which is strong enough to reliably swage the cylindrical part onto the shaft part, but not too strong to break the shaft part or damage the cylindrical part and the fastening tool. Even when the same shaft-retaining multi-piece swage type fastener is used, the appropriate pulling force may vary, for example, depending on the material or specifications of the workpiece. According to the present aspect, the input-accepting part can accept the setting information for a threshold corresponding to the appropriate pulling force which is inputted from the operation part by a user, and the motor-control part can terminate the rearward movement of the pin-gripping part upon application of the appropriate pulling force.

It is noted that the "pulling force" used herein is not limited to the pulling force itself and may be another physical quantity which corresponds to the pulling force. For example, the driving state of the motor (load on the motor) changes as the pulling force increases with progress of the swaging operation. Therefore, a physical quantity corresponding to a load on the motor may be employed as the pulling force. A typical example of such physical quantities may be driving current of the motor. In a case where a rechargeable battery is used as a power source of the fastening tool, for example, an internal resistance value, or a voltage drop value of the battery may also be employed as the physical quantity.

According to one aspect of the present invention, the fastening tool may be configured to use, as the fastener, a tear-off type fastener, in which the pin is inserted through the cylindrical part. The pin may include a shaft part having a small-diameter part for breakage. The pin-gripping part may have a plurality of gripping claws configured to grip the shaft part. Further, the pin-gripping part may be coaxially held within the fastener-abutment part so as to be movable in the front-rear direction along the driving axis relative to the fastener-abutment part, and the pin-gripping part may be configured such that its gripping force of gripping the shaft part changes as the gripping claws move radially relative to the driving axis along with a movement of the pin-gripping part in the front-rear direction relative to the fastener-abutment part. The input-accepting part may be configured to accept, as the setting information, setting information for an initial position of the pin-gripping part in the front-rear direction. The motor-control part may be configured to control operation of the driving mechanism to move the pin-gripping part rearward from the initial position relative to the fastener-abutment part so as to pull the pin gripped by the gripping claws and deform the cylindrical part abutting on the fastener-abutment part, thereby fastening the workpiece between both end portions of the cylindrical part and tearing off the shaft part at the small-diameter part. Further, the motor-control part may further be configured to control operation of the driving mechanism to move the pin-gripping part forward relative to the fastener-abutment part after the shaft part is torn off, and to return the pin-gripping part to the initial position.

In operation of fastening a workpiece by using the tear-off type fastener, the driving mechanism may move the pin-gripping part rearward from the initial position, thereby deforming the cylindrical part and tearing off the shaft part of the pin at the small-diameter part, and thereafter, move the pin-gripping part forward back to the initial position. The pin-gripping part may be configured such that its gripping force of gripping the pin changes as the gripping claws move radially relative to the driving axis along with the movement of the pin-gripping part in the front-rear direction relative to the fastener-abutment part. The pin-gripping part may need to grip the shaft part with an appropriate gripping force in the initial position. However, for example, in a case where the fastener-abutment part or the pin-gripping part is worn, an appropriate positional relationship between the fastener-abutment part and the pin-gripping part may not be maintained so that the gripping part may not be able to appropriately grip the shaft part. According to the present aspect, the input-accepting part can accept setting information for an appropriate initial position which is inputted from the operation part by a user and the motor-control part can perform control to return the pin-gripping part to the appropriate initial position.

It is noted that the setting information for the initial position may refer to information that identifies a position of the pin-gripping part in the front-rear direction when the pin-gripping part is in the initial position. As the setting information for the initial position, for example, the timing of stopping driving of the motor, the number of driving pulses to be supplied to the motor after the pin-gripping part is placed in a specified reference position, and the rotation angle of the motor to be rotated after the pin-gripping part is placed in a specified reference position, may be employed.

According to one aspect of the present invention, the fastening tool may further include a display part configured to display the setting information accepted by the input-accepting part or the control condition based on the setting information. According to the present aspect, a user can check whether or not an appropriate control condition is set, looking at the displayed setting information or control condition. Accordingly, the user can change setting of the control condition by operating the operation part as necessary. The manner of displaying the setting information by the display part is not particularly limited. For example, display of a set value, display of characters indicating a message corresponding to the setting information, or a lighting display using an LED may be employed as the displaying manner.

According to one aspect of the present invention, the display part may be configured to display information other than the setting information. According to the present aspect, useful information for a user, which is other than the setting information for the control condition of the motor, may be displayed, so that convenience can be improved. The "information other than the setting information" used herein is not particularly limited and may include information indicating an error, an outside air temperature and a use history of the fastening tool, for example.

According to one aspect of the present invention, the fastening tool may include the operation part. In other words, the operation part may be provided not as an external device but as part of the fastening tool. In this case, a user can perform both setting of the control condition of the motor and the fastening operation with one device, that is, the fastening tool, so that convenience and operability can be improved.

According to one aspect of the present invention, the operation part may be configured to output the setting information as a digital signal. According to the present aspect, compared with a case employing an operation part (typically, a dial type operation part) which is configured to output an analog signal, fine operation may be facilitated. Further, the risk of changing the control condition by an unintentional operation can be reduced.

According to one aspect of the present invention, the fastening tool may be configured to operate in an input-accepting mode in which the input-accepting part is capable of accepting input of the setting information, and at least one different mode from the input-accepting mode. Preferably, switching from the mode different from the input-accepting mode to the input-accepting mode may be allowed in response to a specific operation different from an operation of inputting the setting information into the operation part. According to the present aspect, when the operation mode of the fastening tool is set to the mode different from the input-accepting mode, a user can be prevented from unintentionally inputting setting information, due to an erroneous operation of the operation part. Further, a user can be prevented from easily switching from the different mode to the input-accepting mode.

According to one aspect of the present invention, the fastening tool may further include a storage device configured to store the setting information accepted by the input-accepting part, or the control condition based on the setting information. The motor-control part may be configured to control driving of the motor according to the control condition based on the setting information stored in the storage device, or the control condition stored in the storage device. According to the present aspect, setting information set via the operation part by a user in the past can be effectively utilized in subsequent fastening operation. In a case where the setting information is stored in the storage device, the motor-control part may always utilize the stored setting information or may utilize the stored setting information only when a specific instruction is inputted via the operation part.

DESCRIPTION OF EMBODIMENT

An embodiment is now described with reference to the drawings. In the following embodiment, as an example, a fastening tool 1 is described which is capable of fastening a workpiece (workpieces) by using a fastener.

Figure 1:
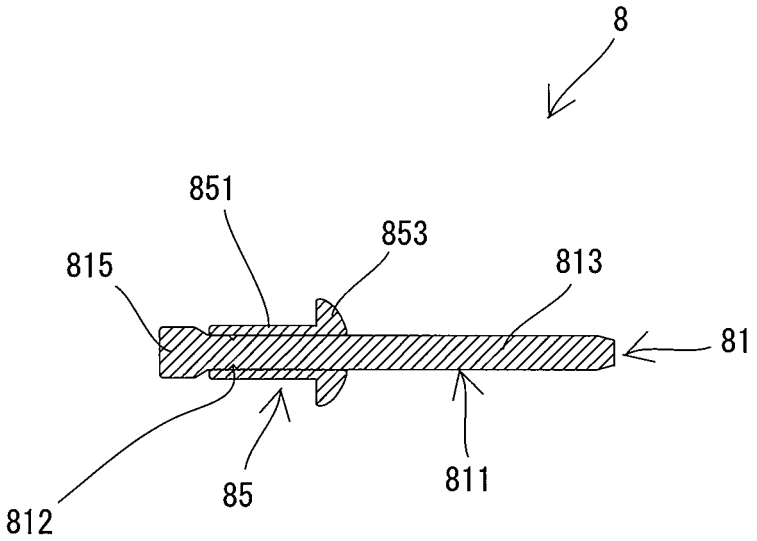
FIG. 1 illustrates a fastener (blind rivet).
Figure 2:
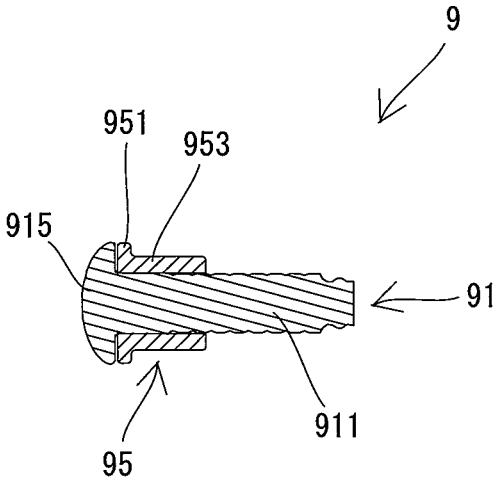
FIG. 2 illustrates a fastener (shaft-retaining multi-piece swage type fastener).

First, fasteners 8 and 9 are described as examples of a fastener which can be used in the fastening tool 1, with reference to FIGS. 1 and 2. The fastener 8 shown in FIG. 1 is a known fastener of a type which is referred to as a blind rivet or a rivet. The fastener 9 shown in FIG. 2 is a known fastener which is referred to as a multi-piece swage type fastener. Further, the fastener 9 is a type of the multi-piece swage type fastener which is referred to as a so-called shaft-retaining type fastener. The structures of the fasteners 8, 9 are now described.

As shown in FIG. 1, the fastener 8 includes a pin 81 and a body 85 which are integrally formed with each other.

The body 85 is a cylindrical body which includes a circular cylindrical sleeve 851 and a flange 853. The flange 853 protrudes radially outward from one end portion of the sleeve 851. The pin 81 is a rod-shaped body extending through the body 85 and protruding from both ends of the body 85. The pin 81 includes a shaft part 811 and a head 815. The head 815 is formed on one end portion of the shaft part 811. The head 815 has a diameter which is larger than an inner diameter of the sleeve 851 and is disposed to protrude from the other end of the sleeve 851 on the side opposite to the flange 853. The shaft part 811 extends through the body 85 and protrudes in an axial direction from the end of the body 85 on the side of the flange 853. A portion of the shaft part 811 which is disposed within the sleeve 851 has a small-diameter part 812 to be broken. The small-diameter part 812 has a lower strength than other portions of the shaft part 811 and is configured to be first broken when the pin 81 is pulled in the axial direction in a fastening process. A portion of the shaft part 811 on the side opposite to the head 815 across the small-diameter part 812 is referred to as a pintail 813. The pintail 813 is a portion to be separated from the pin 81 (the fastener 8) when the shaft part 811 is broken.

As shown in FIG. 2, the fastener 9 includes a pin 91 and a collar 95 which are separately formed from each other.

The pin 91 includes a rod-like shaft part 911 and a head 915 formed on one end portion of the shaft part 911. The head 915 has a circular disc shape having a larger diameter than the shaft part 911. Further, unlike in the fastener 8, the shaft part 911 does not have a small-diameter part for breakage. The collar 95 has a circular cylindrical shape. The collar 95 has a flange 951 protruding radially outward from one end portion of its outer periphery. The outer periphery of the collar 95 except the flange 951 forms an engagement part 953 which is configured to be engaged with a tapered part 617 of an anvil 61B (see FIG. 7), which will be described later, in a fastening operation. The engagement part 953 is a region of the collar 95 to be swaged and deformed with a swaging force applied by the anvil 61B. The inner diameter of the collar 95 is set to be slightly larger than the diameter of the shaft part 911 of the pin 91. The shaft part 911 of the pin 91 may be inserted through the collar 95 so that the collar 95 is engaged with the pin 91. An end region of the pin 91 on the side opposite to the head 915 protrudes from the collar 95 when the pin 91 is engaged with the collar 95.

In the fastening tool 1, in addition to the fastener 8 shown as an example in FIG. 1, other blind-rivet type fasteners can also be used which are each different, for example, in the axial lengths or diameters of the pin 81 and the body 85 or the position of the small-diameter part 812. Further, in addition to the fastener 9 shown as an example in FIG. 2, plural kinds of the shaft-retaining multi-piece swage type fasteners can also be used which are each different, for example, in the axial lengths or diameters of the pin 91 and the collar 95. Furthermore, although not shown in the drawings and not described in detail, multi-piece swage type fasteners of a tear-off type can also be used in the fastening tool 1. Like the fastener 9, the tear-off multi-piece swage type fastener includes a pin and a collar which are separately formed from each other. The pin is longer than the pin 91 of the fastener 9 and has a small-diameter part for breakage, like in the fastener 8, and in a fastening process, a pintail of the pin is torn off. Therefore, a blind rivet such as the fastener 8 and a tear-off multi-piece swage type fastener can be collectively referred to as a tear-off type fastener.

The fastening tool 1 is now described. First, the structure of the fastening tool 1 is briefly described with reference to FIG. 3.

Figure 3:
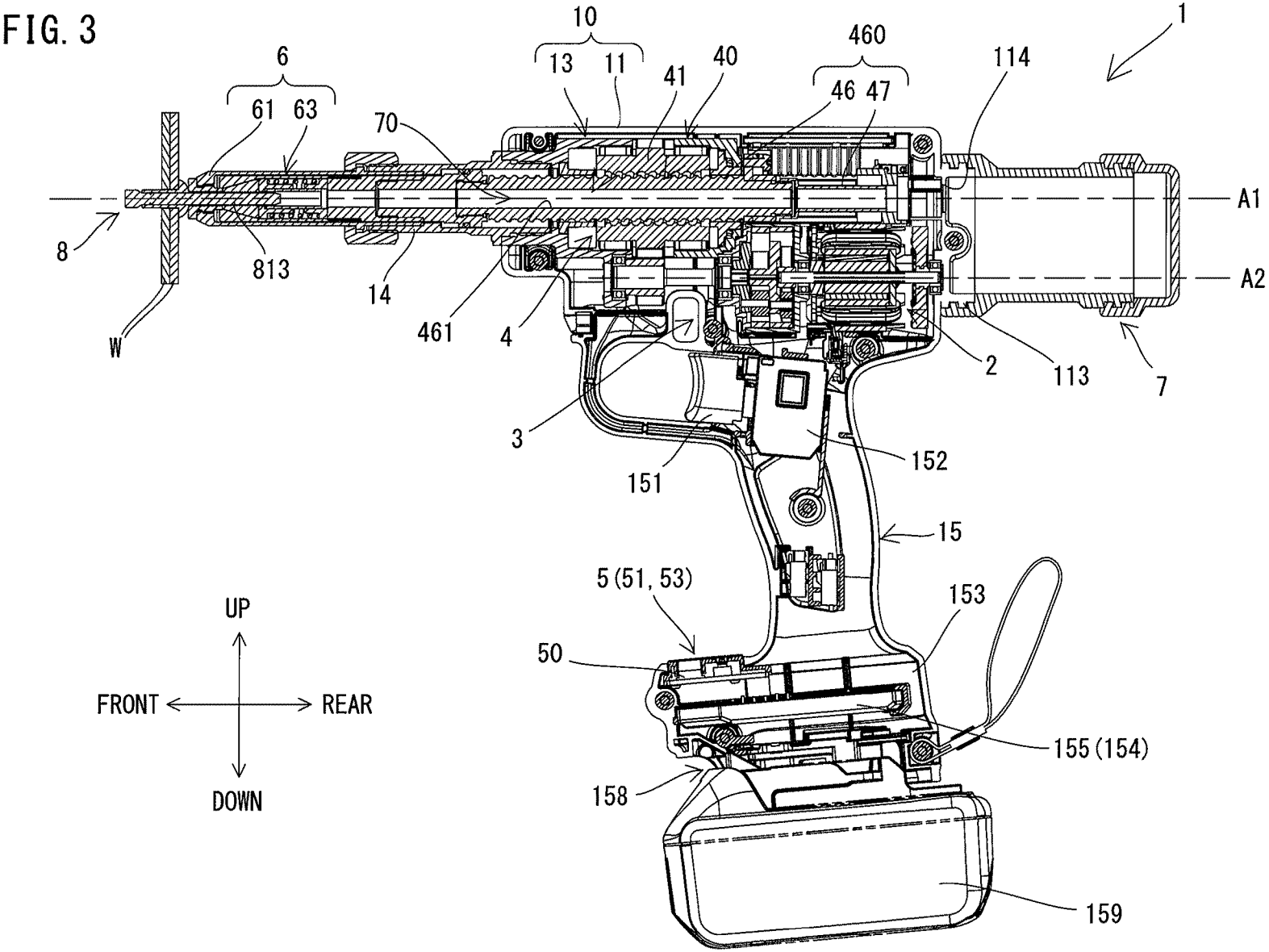
FIG. 3 is a vertical sectional view showing a fastening tool when a screw shaft is located in an initial position.

As shown in FIG. 3, an outer shell of the fastening tool 1 is mainly formed by an outer housing 11, a handle 15 and a nose part 6 which is held via a nose-holding member 14.

In the present embodiment, the outer housing 11 has a generally rectangular box-like shape and extends along a specified driving axis A1. The nose part 6 is held by one end portion of the outer housing 11 in a longitudinal-axis direction via the nose-holding member 14 so as to extend along the driving axis A1. A container 7 is removably mounted to the other end portion of the outer housing 11. The container 7 is configured to store the pintail 813 separated in a fastening process. The handle 15 protrudes in a direction crossing (in the present embodiment, in a direction generally orthogonal to) the driving axis A1 from a central portion of the outer housing 11 in the longitudinal-axis direction.

In the following description, for convenience of explanation, as for the directions of the fastening tool 1, an extending direction of the driving axis A1 (also referred to as the longitudinal-axis direction of the outer housing 11) is defined as a front-rear direction of the fastening tool 1, the side on which the nose part 6 is disposed is defined as a front side and the side on which the container 7 is removably mounted is defined as a rear side. Further, a direction orthogonal to the driving axis A1 and corresponding to the extending direction of the handle 15 is defined as an up-down direction, the side on which the outer housing 11 is disposed is defined as an upper side and a protruding end (free end) side of the handle 15 is defined as a lower side. A direction orthogonal to the front-rear direction and the up-down direction is defined as a right-left direction.

As shown in FIG. 3, the outer housing 11 mainly houses a motor 2, a driving mechanism 4 which is configured to be driven by power of the motor 2, and a transmitting mechanism 3 which is configured to transmit the power of the motor 2 to the driving mechanism 4. In the present embodiment, a portion (specifically, a nut 41 of a ball-screw mechanism 40) of the driving mechanism 4 is housed in an inner housing 13. The inner housing 13 is fixedly held by the outer housing 11. From this point of view, the outer housing 11 and the inner housing 13 can be considered as one piece in the form of a housing 10.

The handle 15 is configured to be held by a user. A trigger 151 is provided in an upper end portion (a base end portion connected to the outer housing 11) of the handle 15 and configured to be depressed by the user. A battery-mounting part 158 is provided on a lower end portion of the handle 15 and configured such that a battery 159 is removably mounted thereto. The battery 159 is a rechargeable power source for supplying electric power to various components and the motor 2 of the fastening tool 1. The structures of the battery-mounting part 158 and the battery 159 are well known and therefore not described here.

The fastening tool 1 of the present embodiment is configured as a so-called common-type device which is capable of fastening both of tear-off type fasteners like the fastener 8 (see FIG. 1) and shaft-retaining type fasteners like the fastener 9 (see FIG. 2). Accordingly, the nose part 6 is configured to be removably attached to the housing 10, and plural kinds of nose parts 6 are available, which includes a nose part 6A (see FIG. 6) and a nose part 6B (see FIG. 7) which are respectively designed to correspond to the fasteners 8 and 9. In use, the user may attach to the fastening tool 1 the nose part 6 for a fastener to be actually used. In the following description, the nose parts 6A and 6B are described as examples of the nose part 6, but the term "nose part 6" is used when referring to these nose parts collectively or without any distinction.

The common-type fastening tool 1 is configured to appropriately operate according to the kind of the fastener to be actually used. Although detailed operations of the fastening tool 1 using the fasteners 8 and 9 will be described later, general operations are now briefly described.

When the fastener 8 is used, the fastener 8 is gripped by a pin-gripping part 63A, which will be described later, while a portion of the pintail 813 is inserted into a front end portion of the nose part 6 of the fastening tool 1 and the body 85 and the head 81 protrude from a front end of the nose part 6 (see FIG. 6). The sleeve 851 is inserted through a mounting hole formed in workpieces W up to a position where the flange 853 abuts on one side of the workpieces W to be fastened. When the trigger 151 is depressed, the driving mechanism 4 is driven via the motor 2. Then, when the pintail 813 gripped by the pin-gripping part 63A is strongly pulled rearward, an end portion of the sleeve 851 on the head 815 side radially expands and the workpieces W are clamped between this expanded end portion and the flange 853. Further, the shaft part 811 is broken at the small-diameter part 812 and the pintail 813 is separated from the shaft part 811. Thereafter, the fastening process is completed when the pin-gripping part 63A is returned forward to an initial position by the driving mechanism 4.

When the fastener 9 is used, the shaft part 911 of the pin 91 is inserted through the mounting hole formed in the workpieces W such that the head 915 is held in abutment with one side of the workpieces W. Thereafter, the collar 95 is loosely engaged onto the shaft part 911 from the opposite side of the workpieces W, and an end region of the shaft part 911 which protrudes from the collar 95 is gripped by a pin-gripping part 63B (see FIG. 7), which will be described later. When the trigger 151 is depressed and the driving mechanism 4 is accordingly driven, the shaft part 911 gripped by the pin-gripping part 63B is pulled rearward, so that the collar 95 is swaged onto the shaft part 911. When an appropriate swaging force is applied to the collar 95, the pin-gripping part 63B is returned forward to an initial position while gripping the shaft part 911 onto which the collar 95 has been swaged, and thus the fastening process is completed.

As described above, in the present embodiment, the fastening tool 1 is configured to perform a fastening process for fastening the workpieces W with the fastener 8 or 9 in one cycle of operation which starts when the driving mechanism 4 moves the pin-gripping part 63 rearward from the forward initial position and ends when the driving mechanism 4 returns the pin-gripping part 63 to the initial position. However, a position at which the pin-gripping part 63 moving rearward is stopped is different, depending on which of the fasteners 8 and 9 is used. This is because, in the case of the tear-off type fastener 8, the pin-gripping part 63 is moved rearward to a specified position where a pulling force which is larger than a pulling force required to break the shaft part 811 at the small-diameter part 812 can be applied, while, in the case of the shaft-retaining type fastener 9, a rearward movement of the pin-gripping part 63 is stopped upon application of a pulling force which is strong enough to reliably swage the collar 95 onto the shaft part 911 but not strong enough to break the shaft part 911. The fastening process will be described in further detail later.

The physical configuration of the fastening tool 1 is now described in detail.

Figure 4:
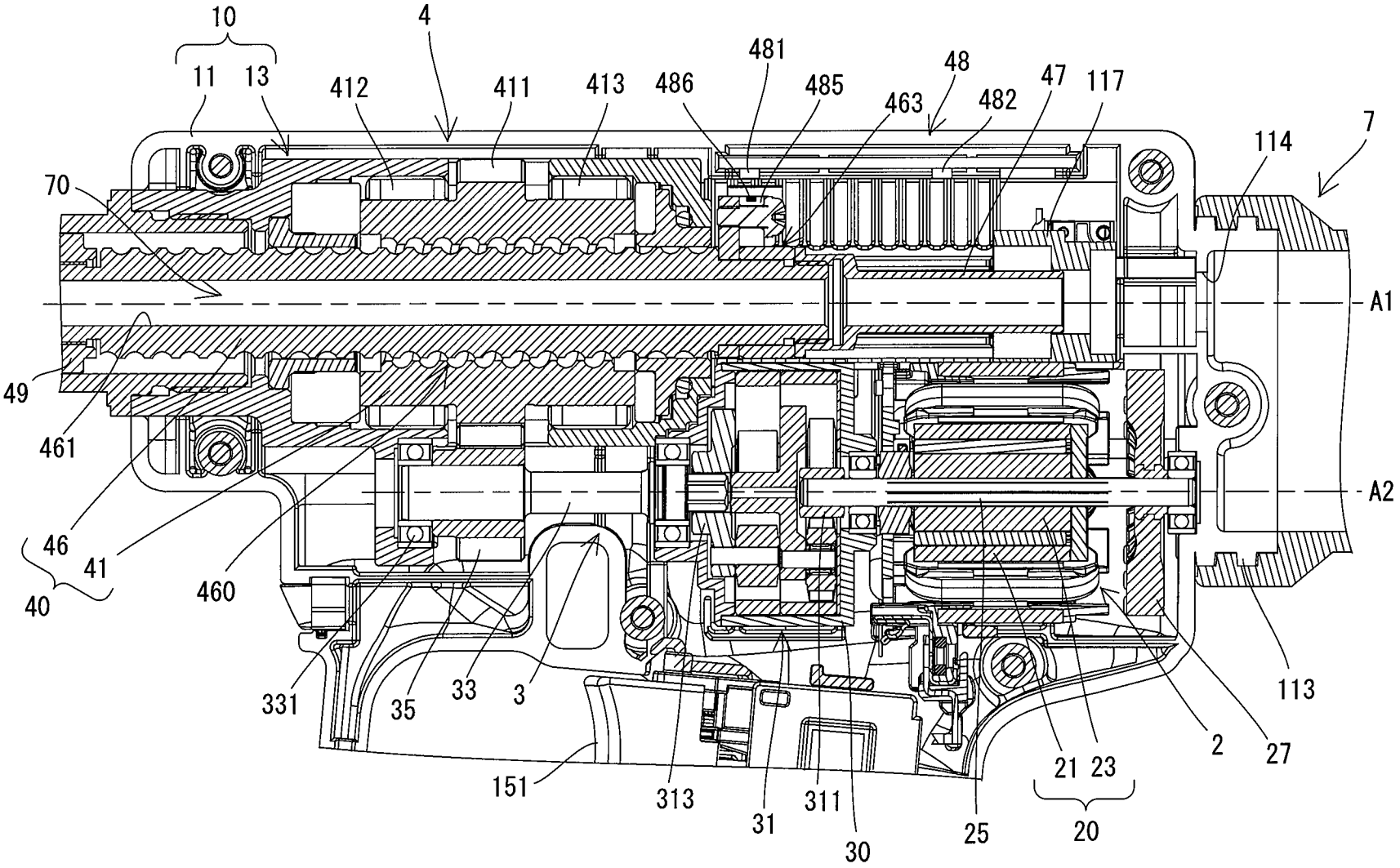
FIG. 4 is a partial, enlarged view of FIG. 3.

First, the motor 2 is described. As shown in FIG. 4, the motor 2 is housed in a lower rear end portion of the outer housing 11. In the present embodiment, a compact and high-output brushless direct current (DC) motor is employed as the motor 2. The motor 2 includes a motor body 20 which includes a stator 21 and a rotor 23, and a motor shaft 25 which extends from the rotor 23 and is configured to rotate together with the rotor 23. The motor 2 is arranged such that a rotation axis A2 of the motor shaft 25 extends in parallel to the driving axis A1 (that is, in the front-rear direction) below the driving axis A1. A front end portion of the motor shaft 25 protrudes into a reduction gear housing 30. A fan 27 for cooling the motor 2 is fixed to a rear end portion of the motor shaft 25.

Next, the transmitting mechanism 3 is described. As shown in FIG. 4, in the present embodiment, the transmitting mechanism 3 mainly includes a planetary gear reducer 31, an intermediate shaft 33 and a nut-driving gear 35, which are now described in this order.

The planetary gear reducer 31 is disposed on the downstream side of the motor 2 on a power transmission path from the motor 2 to the driving mechanism 4 (specifically, a ball-screw mechanism 40). The planetary gear reducer 31 is configured to increase torque of the motor 2 and transmit it to the intermediate shaft 33. In the present embodiment, the planetary gear reducer 31 mainly includes two sets of planetary gear mechanisms and the reduction gear housing 30 which houses the planetary gear mechanisms. The structure of the planetary gear mechanism itself is well known and therefore not described in further detail here. The motor shaft 25 is used as an input shaft for inputting rotating power into the planetary gear reducer 31. A sun gear 311 of a first (upstream) planetary gear mechanism of the planetary gear reducer 31 is fixed to a front end portion (which protrudes into the reduction gear housing 30) of the motor shaft 25. A carrier 313 of a second (downstream) planetary gear mechanism is used as a final output shaft of the planetary gear reducer 31.

The intermediate shaft 33 is configured to rotate together with the carrier 313. Specifically, the intermediate shaft 33 is rotatably supported and arranged coaxially with the motor shaft 25. A rear end portion of the intermediate shaft 33 is connected to the carrier 313. The nut-driving gear 35 is fixed onto an outer periphery of a front end portion of the intermediate shaft 33. The nut-driving gear 35 is meshed with a driven gear 411 (described later) formed on an outer periphery of the nut 41. The nut-driving gear 35 is configured to transmit the rotating power of the intermediate shaft 33 to the nut 41. The nut-driving gear 35 and the driven gear 411 are configured as a speed reducing gear mechanism.

The driving mechanism 4 is now described.

As shown in FIG. 4, in the present embodiment, the driving mechanism 4 mainly includes the ball-screw mechanism 40 which is housed in an upper portion of the outer housing 11. The structures of the ball-screw mechanism 40 and other components around the ball-screw mechanism 40 are now described.

Figure 5:
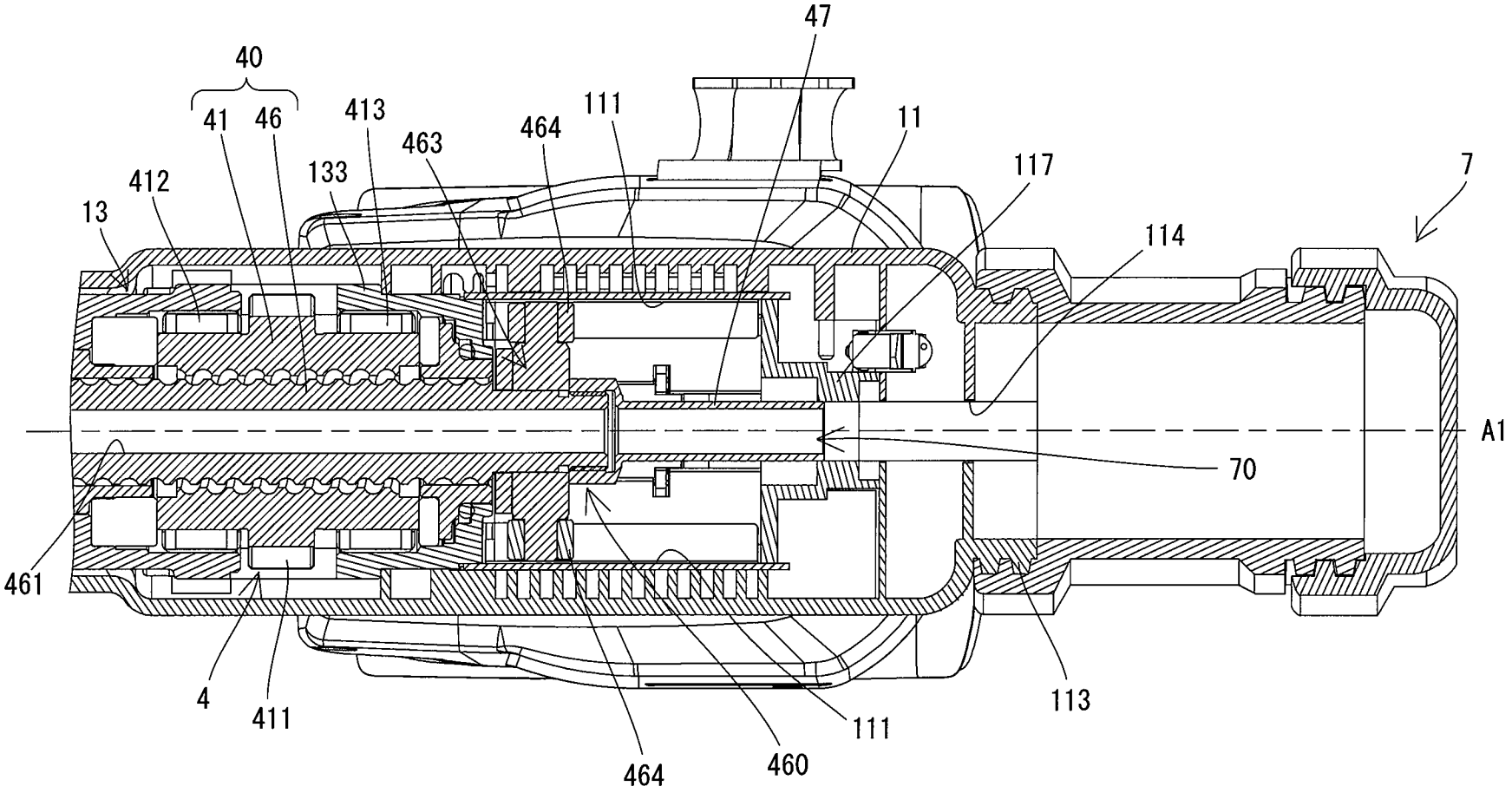
FIG. 5 is a horizontal sectional view of a rear part of the fastening tool.

As shown in FIGS. 4 and 5, the ball-screw mechanism 40 mainly includes the nut 41 and a screw shaft 46. In the present embodiment, the ball-screw mechanism 40 is configured to convert rotation of the nut 41 into linear motion of the screw shaft 46 and to linearly move the pin-gripping part 63 to be described later (see FIGS. 6 and 7).

In the present embodiment, the nut 41 is supported by the inner housing 13 in a state in which its movement in the front-rear direction is restricted and its rotation around the driving axis A1 is allowed. The nut 41 is circular cylindrically shaped and has the driven gear 411 integrally provided on its outer periphery. The nut 41 is supported, via a pair of radial bearings 412 and 413 which are fitted onto the nut 41 on the front and rear sides of the driven gear 411, so as to be rotatable around the driving axis A1 relative to the inner housing 13. The driven gear 411 is meshed with the nut-driving gear 35. The driven gear 411 is configured to receive the rotating power of the motor 2 from the nut-driving gear 35, which causes the nut 41 to rotate around the driving axis A1.

The screw shaft 46 is engaged with the nut 41 in a state in which its rotation around the driving axis A1 is restricted and its movement along the driving axis A1 in the front-rear direction is allowed. Specifically, as shown in FIGS. 4 and 5, the screw shaft 46 is configured as an elongate body, and inserted through the nut 41 so as to extend along the driving axis A1. A number of balls (not shown) are rollably disposed within a spiral track which is defined by a spiral groove formed in an inner peripheral surface of the nut 41 and a spiral groove formed in an outer peripheral surface of the screw shaft 46. The screw shaft 46 is engaged with the nut 41 via these balls. Thus, the screw shaft 46 linearly moves along the driving axis A1 in the front-rear direction when the nut 41 is rotationally driven.

As shown in FIG. 5, a central portion of a roller-holding part 463 is fixed to a rear end portion of the screw shaft 46. The roller-holding part 463 has arms respectively protruding leftward and rightward from the central part, orthogonally to the screw shaft 46. Rollers 464 are rotatably held on right and left end portions of the arms of the roller-holding part 463, respectively. Roller guides 111 extending in the front-rear direction are fixed to right and left inner walls of the outer housing 11, respectively, corresponding to the right and left rollers 464. Although not shown in detail, an upward movement and a downward movement of the rollers 464 are restricted by the roller guides 111. Therefore, the roller 464 disposed within the roller guide 111 can roll along the roller guide 111 in the front-rear direction.

In the ball-screw mechanism 40 having the above-described structure, when the nut 41 is rotated around the driving axis A1, the screw shaft 46 engaged with the nut 41 via the balls linearly moves in the front-rear direction relative to the nut 41 and the housing 10. When the nut 41 is rotated, the screw shaft 46 may be subjected to torque around the driving axis A1. By abutment of the rollers 464 on the roller guides 111, however, the rotation of the screw shaft 46 around the driving axis A1 due to such torque is restricted.

The peripheral structure of the rear end portion of the screw shaft 46 and the internal configuration of the rear end portion of the outer housing 11 in which the rear end portion of the screw shaft 46 is disposed are now described.

As shown in FIG. 4, a magnet-holding part 485 is fixed to the roller-holding part 463 which is fixed to the rear end portion of the screw shaft 46. The magnet-holding part 485 is disposed on an upper side of the screw shaft 46, and a magnet 486 is mounted on an upper end of the magnet-holding part 485. The magnet 486 is fixed to be part of the screw shaft 46, so that the magnet 486 moves in the front-rear direction along with the movement of the screw shaft 46 in the front-rear direction.

A position-detecting mechanism 48 is provided in the outer housing 11. In the present embodiment, the position-detecting mechanism 48 includes a first sensor 481 and a second sensor 482. The second sensor 482 is disposed rearward of the first sensor 481. Further, in the present embodiment, the first and second sensors 481 and 482 are each configured as a Hall sensor having a Hall element. The first and second sensors 481 and 482 are both connected to a controller 154 (see FIG. 9) via wiring (not shown) and configured to output their respective specified detection signals to the controller 154 when the magnet 486 is located within their respective specified detection ranges. In the present embodiment, detection results by the first and second sensors 481, 482 are used to control driving of the motor 2 by the controller 154, which will be described in detail later.

As shown in FIGS. 4 and 5, an extension shaft 47 is coaxially connected and fixed to the rear end portion of the screw shaft 46 and integrated with the screw shaft 46. The screw shaft 46 and the extension shaft 47 which are integrated with each other are hereinafter also collectively referred to as a driving shaft 460. The driving shaft 460 has a through hole 461 extending through the driving shaft 460 along the driving shaft A1. The diameter of the through hole 461 is set to be slightly larger than the largest possible diameter of a pintail of a fastener which can be used in the fastening tool 1.

An opening 114 is formed on the driving axis A1 in the rear end portion of the outer housing 11 and allows communication between the inside and the outside of the outer housing 11. A cylindrical guide sleeve 117 having an inner diameter generally equal to the outer diameter of the extension shaft 47 is fixed in front of the opening 114. A rear end portion of the extension shaft 47 (the driving shaft 460) is located within the guide sleeve 117 when the screw shaft 46 (the driving shaft 460) is placed in an initial position (shown in FIGS. 4 and 5). When the screw shaft 46 (the driving shaft 460) is moved rearward from the initial position along with rotation of the nut 41, the extension shaft 47 moves rearward while sliding within the guide sleeve 117.

As shown in FIGS. 4 and 5, a container connection part 113 is formed on the rear end portion of the outer housing 11. The container connection part 113 has a circular cylindrical shape and protrudes rearward. The container connection part 113 is configured such that the container 7 for the pintail 813 is removably attached thereto. The container 7 is formed as a circular cylindrical member with a lid. The user can attach the container 7 to the outer housing 11 via the container connection part 113 such that the opening 114 communicates with the internal space of the container 7.

The structure of the nose part 6 is now described. Directions of the nose part 6 are described on the basis of the state of the nose part 6 attached to the housing 10.

As shown in FIG. 3, the nose part 6 mainly includes an anvil 61 and the pin-gripping part 63. As described above, however, the nose parts 6A (see FIG. 6) and 6B (see FIG. 7), which are respectively designed to correspond to the fasteners 8 and 9, are available for the fastening tool 1 of the present embodiment. The nose parts 6A and 6B are different in the detailed structures of the anvil 61 and the pin-gripping part 63. In the following description, the anvil 61 and the pin-gripping part 63 of the nose part 6A are referred to as an anvil 61A and a pin-gripping part 63A, respectively, and the anvil 61 and the pin-gripping part 63 of the nose part 6B are referred to as an anvil 61B and a pin-gripping part 63B, respectively.

The anvils 61A and 61B are configured to abut on the body 85 and the collar 95 which are both cylindrically formed, respectively, and to be removably attached to the housing 10 via the nose-holding member 14. Further, the pin-gripping parts 63A and 63B are respectively configured to grip the shafts 811 and 911 of the pins 81 and 91 and disposed to be movable along the driving axis A1 relative to the anvils 61A and 61B. In this sense, it can be said that the nose parts 6A and 6B have basically the same structure.

First, the nose part 6A for the tear-off type fastener 8 is described with reference to FIG. 6.

Figure 6:
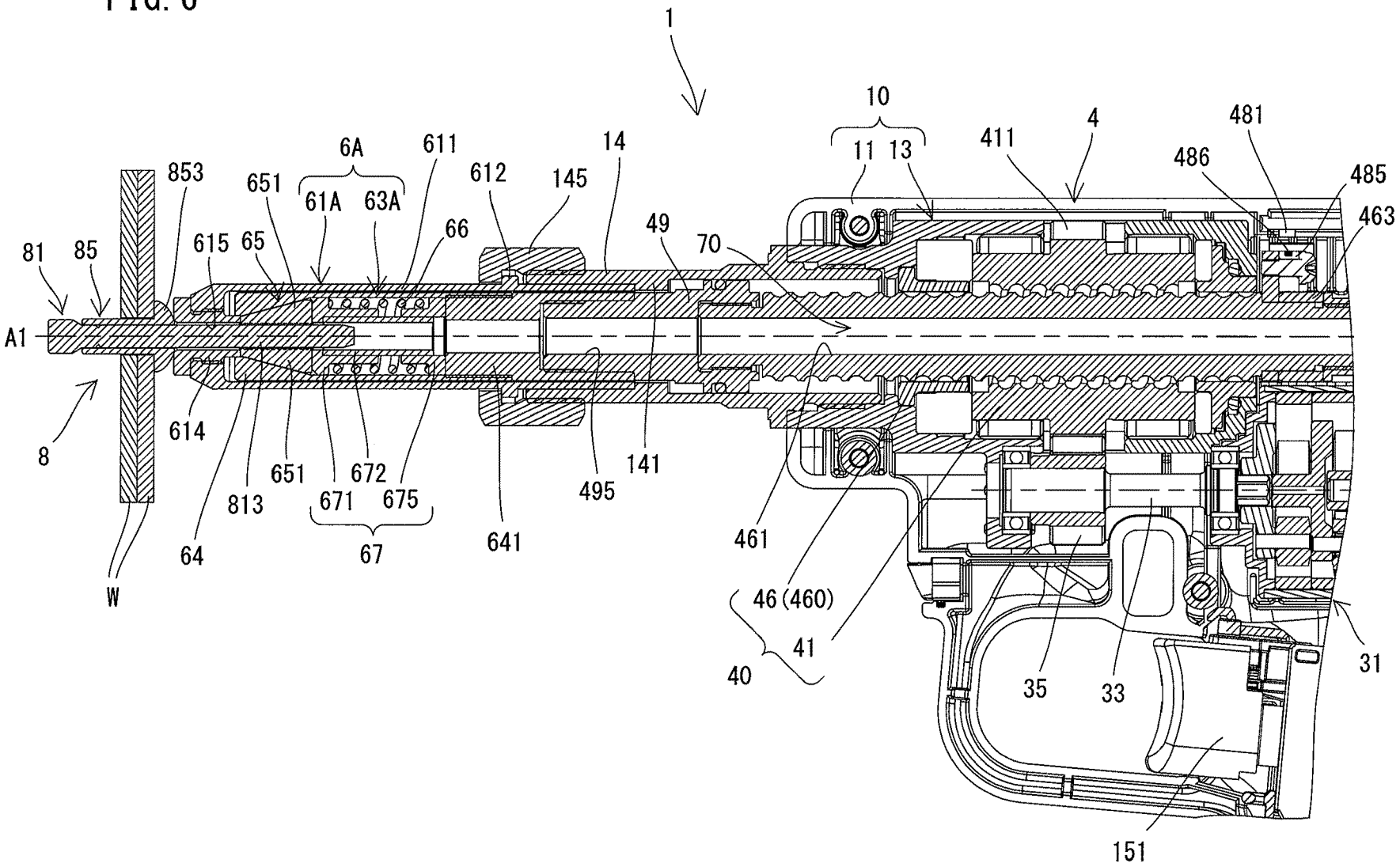
FIG. 6 is another partial, enlarged view of FIG. 3, with a nose part for the fastener shown in FIG. 1 being attached thereto.

As shown in FIG. 6, in the present embodiment, the anvil 61A includes an elongate circular cylindrical sleeve 611 and a nose tip 614 fixed to a front end portion of the sleeve 611. The inner diameter of the sleeve 611 is set to be generally equal to the outer diameter of a jaw case 64 of the pin-gripping part 63A, which will be described later. The sleeve 611 has a locking rib 612 protruding radially outward in a region slightly toward a rear end from a central portion of an outer periphery of the sleeve 611. The nose tip 614 is configured such that its front end portion abuts on the flange 853 of the fastener 8 and arranged such that its rear end portion protrudes into the sleeve 611. The nose tip 614 has an insertion hole 615 through which the pintail 813 can be inserted.

The pin-gripping part 63A is now described. As shown in FIG. 6, in the present embodiment, the pin-gripping part 63A mainly includes the jaw case 64, a connecting member 641, a jaw 65 and a biasing spring 66, which are now described in this order. The pin-gripping part 63A may also be referred to as a jaw assembly.

The jaw case 64 is circular cylindrically shaped, so as to be slidable within the sleeve 611 of the anvil 61A along the driving axis A1 and to hold the jaw 65 inside. The jaw case 64 has a generally uniform inner diameter, except that only its front end portion is configured as a tapered part reducing in inner diameter toward the front. Specifically, an inner peripheral surface of the front end portion of the jaw case 64 is configured as a conical tapered surface reducing in diameter toward its front end. Further, a front end portion of the connecting member 641, which has a circular cylindrical shape, is threadedly engaged with a rear end portion of the jaw case 64 and integrated with the jaw case 64. A rear end portion of the connecting member 641 is configured to be threadedly engaged with a front end portion of a connecting member 49, which will be described later.

The jaw 65 is formed as a cylindrical body which has a conical shape as a whole, corresponding to the tapered surface of the jaw case 64. The jaw 65 is disposed coaxially with the jaw case 64 within the front end portion of the jaw case 64. The jaw 65 is configured to grip a portion of the pintail 813 and includes a plurality of (for example, three) claws 651 disposed around the driving axis A1. An inner peripheral surface of the claw 651 is formed to have irregularities so as to improve ease of gripping the pintail 813.

The biasing spring 66 is disposed between the jaw 65 and the connecting member 641 in the front-rear direction. The jaw 65 is biased forward by a biasing force of the biasing spring 66 and its outer peripheral surface is held in abutment with the tapered surface of the jaw case 64. Further, in the present embodiment, the biasing spring 66 is held by a spring holding members 67 disposed between the jaw 65 and the connecting member 641.

The spring holding members 67 include circular cylindrical first and second members 671 and 675 which are disposed to be slidable along the driving axis A1 within the jaw case 64. The first member 671 is disposed on the front side and abuts on the jaw 65, and the second member 675 is disposed on the rear side and abuts on the connecting member 641. The first and second members 671 and 675 have an outer diameter smaller than the inner diameter of the jaw case 64, and respectively have front and rear end portions formed with a flange protruding radially outward. The outer diameters of the flanges are generally equal to the inner diameter of the jaw case 64 (except for the tapered part). The biasing spring 66 is mounted on the first and second members 671 and 675 with its front and rear ends being in abutment with the flanges of the first and second members 671 and 675, respectively. Further, a circular cylindrical sliding part 672 is fixed in the inside of the first member 671 and protrudes rearward. A rear end portion of the sliding part 672 is slidably inserted into the second member 675. The inner diameter of the sliding part 672 is generally equal to the diameter of the through hole 461 of the screw shaft 46.

With the above-described structure, when the jaw case 64 moves in the driving axis A1 direction relative to the anvil 61A, the positional relationship between the jaw case 64 and the jaw 65 in the axial direction of the driving axis A1 changes, due to the biasing force of the biasing spring 66. During this time, each of the claws 651 of the jaw 65 moves in the axial direction and a radial direction of the driving axis A1 while a tapered outer peripheral surface of the claw 651 slides on the tapered surface of the jaw case 64, so that the adjacent claws 651 move closer to or away from each other. As a result, the gripping force of the jaw 65 (the claws 651) gripping the pintail 813 changes.

Specifically, when the screw shaft 46 is located in the initial position shown in FIG. 6, the jaw 65 is held in abutment with a rear end of the above-described nose tip 614 protruding into the front end portion of the jaw case 64, while the tapered outer peripheral surfaces of the claws 651 are in abutment with the tapered surface of the jaw case 64. It should be noted that the initial position of the screw shaft 46 (the driving shaft 460) (in other words, the initial position of the pin-gripping part 63A) needs to be set to a position where the claws 651 of the jaw 65 can appropriately grip the pin 81. In the present embodiment, the initial positions of the screw shaft 46 and the pin-gripping part 63 can be adjusted according to setting information inputted via an operation part 51 by the user, which will be described in detail later.

When the pin-gripping part 63A moves rearward along the driving axis A1 relative to the anvil 61A, the jaw case 64 moves rearward relative to the jaw 65 biased forward by the biasing spring 66. The claws 651 move toward each other in the radial direction by cooperation of the tapered surfaces of the claws 651 and the tapered surface of the jaw case 64. As a result, the gripping force of the jaw 65 (the claws 651) gripping the pintail 813 is increased so that the pintail 813 is firmly gripped. On the other hand, when the pin-gripping part 63 is returned forward along the driving axis A1, the jaw 65 abuts on the rear end of the nose tip 614 and the jaw case 64 moves forward relative to the jaw 65. The claws 651 are then allowed to move away from each other in the radial direction. As a result, the gripping force of the jaw 65 (the claws 651) gripping the pintail 813 is reduced so that the pintail 813 can be released from the jaw 65 by application of an external force.

The nose part 6B for the shaft-retaining type fastener 9 is now described with reference to FIG. 7.

Figure 7:
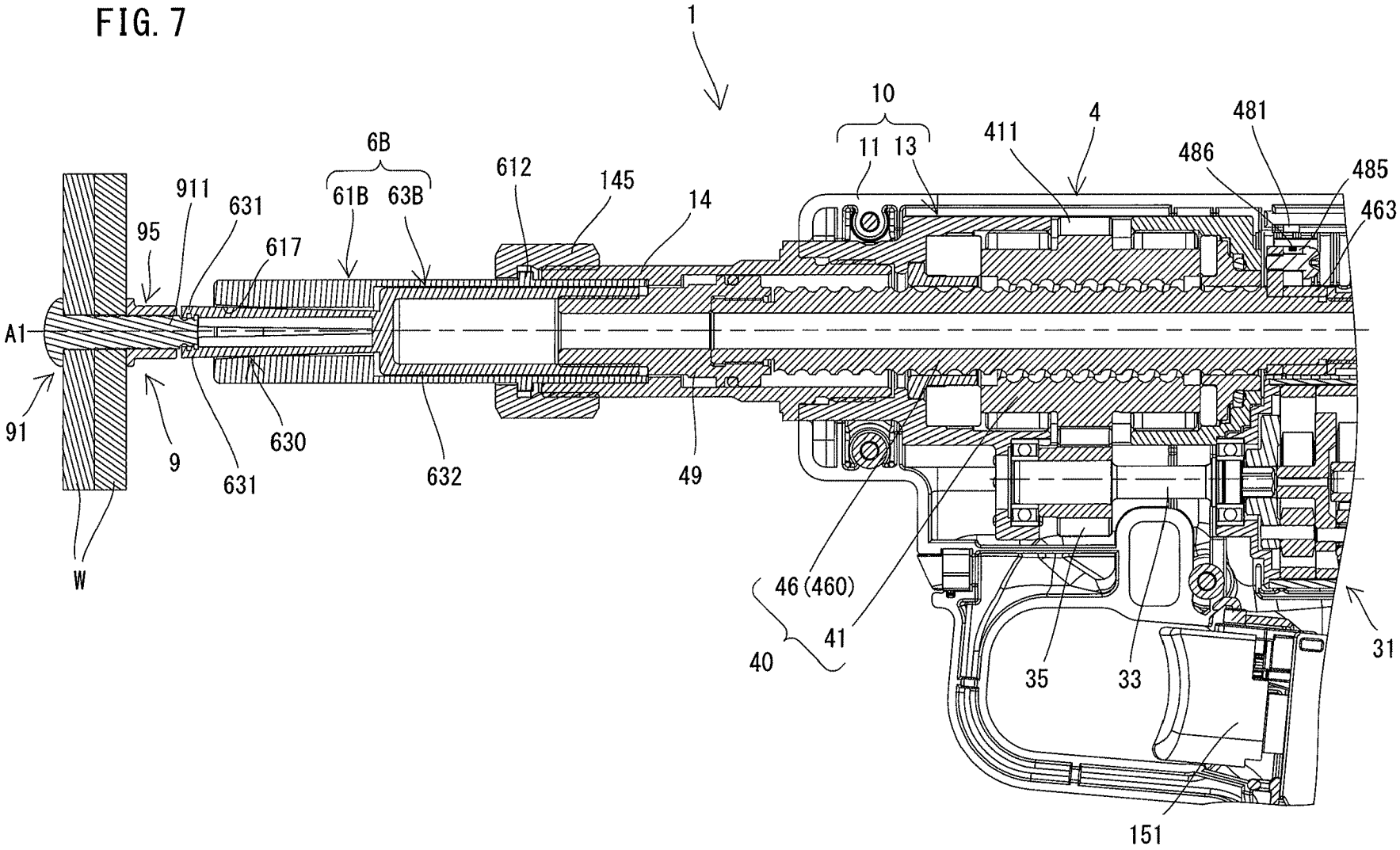
FIG. 7 is a partial, enlarged view corresponding to FIG. 6, with a nose part for the fastener shown in FIG. 2 being attached thereto.

As shown in FIG. 7, in the present embodiment, the anvil 61B is configured as an elongate circular cylindrical sleeve. Like the anvil 61A, the anvil 61B has a locking rib 612 protruding radially outward in a region slightly toward a rear end from a central portion of an outer periphery of the anvil 61B. A rear region of the anvil 61B is formed to have an inner diameter generally equal to an outer diameter of a base part 632 of the pin-gripping part 63B described below, while a front region of the anvil 61B is formed to have an inner diameter smaller than the inner diameter of the rear region. Further, a front end portion of the front region is formed as a tapered part 617, gradually increasing in inner diameter toward an open end (front end). The length of the tapered part 617 is set to be slightly longer than the height (length) of the engagement part 953 (see FIG. 2) of the collar 95 in the front-rear direction. The inner diameter of the tapered part 617 is set to be slightly larger at the open end, but smaller in the other region extending rearward from the open end than the outer diameter of the engagement part 953. With such a structure, when acted upon by an axial force which is strong enough to deform the engagement part 953, the engagement part 953 enters the tapered part 617 from the open end while deforming.

The pin-gripping part 63B is disposed to be slidable along the driving axis A1 within the anvil 61B. In the present embodiment, the pin-gripping part 63B includes a jaw 630 and a base part 632. The jaw 630 is configured to grip an end region of the shaft part 911 of the fastener 9. The base part 632 is formed integrally with the jaw 630.

The jaw 630 includes a plurality of (for example, three) claws 631. The claws 631 are equidistantly arranged on an imaginary circumference around the driving axis A1. Further, the jaw 630 is configured such that the distance between the adjacent claws 631 increases toward the front end. The length of the jaw 630 in the front-rear direction is set such that a front end portion of the claws 631 protrude forward from a front end of the tapered part 617 of the anvil 61B when the pin-gripping part 63B is located in the initial position shown in FIG. 7. Further, the base part 632 has a bottomed circular cylindrical shape having a closed front end. A rear end portion of the base part 632 is configured to be threadedly engaged with a front end portion of the connecting member 49. Thus, the pin-gripping part 63B is removably attachable to the screw shaft 46 via the connecting member 49. With the above-described structure, the gripping force of the jaw 630 (the claws 631) increases as the jaw 630 is retracted into the anvil 61B and moved rearward.

The nose-holding member 14 is now described.

As shown in FIG. 6, the nose-holding member 14 has a circular cylindrical shape, and is fixed to a front end portion of the housing 10 so as to extend forward along the driving axis A1. More specifically, the nose-holding member 14 is threadedly engaged with a cylindrical front end portion of the inner housing 13 and thereby integrally connected to the housing 10. The inner diameter of a rear portion of the nose-holding member 14 is set to be larger than the outer diameter of the screw shaft 46. Further, the nose-holding member 14 has an annular locking part 141 protruding radially inward in its central portion in the front-rear direction. The inner diameter of a portion of the nose-holding member 14 which forms the locking part 141 is set to be generally equal to the outer diameter of the pin-gripping part 63, and the inner diameter of a portion of the nose-holding member 14 which extends forward from the locking part 141 is set to be generally equal to the outer diameter of the anvil 61.

The connecting member 49 is connected to a front end portion of the screw shaft 46. The connecting member 49 is configured to connect the screw shaft 46 and the pin-gripping part 63. The connecting member 49 has a circular cylindrical shape, and is integrally connected to the screw shaft 46 with its rear end portion being threadedly engaged with the front end portion of the screw shaft 46. The connecting member 49 can slide within the nose-holding member 14 along with the movement of the screw shaft 46 in the front-rear direction. The front end portion of the connecting member 49 is threadedly engaged with the rear end portion of the pin-gripping part 63 (specifically, of the connecting member 641 of the pin-gripping part 63A, or of the pin-gripping part 63B). Thus, the pin-gripping part 63 is integrally connected to the screw shaft 46 via the connecting member 49. When the connecting member 49 is connected to the connecting member 641 of the pin-gripping part 63A, a through hole 495 extending through both of the connecting members 49 and 641 is defined. The diameter of the through hole 495 is generally equal to that of the through hole 461 of the screw shaft 46.

The nose part 6 may be connected to the housing 10 as follows. After the pin-gripping part 63 is connected to the connecting member 49 as described above, a rear end portion of the anvil 61 is inserted into the nose-holding member 14. Further, a cylindrical fixing ring 145 is threadedly engaged with an outer periphery of the front end portion of the nose-holding member 14, so that the nose part 6 is connected to the housing 10 via the nose-holding member 14. The anvil 61 is positioned such that its rear end abuts on the locking part 141 of the nose-holding member 14 and the locking rib 612 is disposed between a front end portion of the fixing ring 145 and a front end of the nose-holding member 14.

When the nose part 6A for the tear-off type fastener 8 is connected to the housing 10 via the nose-holding member 14, as shown in FIG. 3, a passage 70 is defined which extends from a front end of the nose part 6A to the opening 114 of the outer housing 11 along the driving axis A1. More specifically, the passage 70 is defined by the insertion hole 615 of the nose tip 614, the inside of the jaw 65, the inside of the spring holding members 67, the through hole 495 (see FIG. 6) of the connecting members 641 and 49, the through hole 461 of the driving shaft 460 and the opening 114. The pintail 813 separated from the fastener 8 may pass through the passage 70 and enter the container 7 to be stored therein.

The handle 15 is now described.

As shown in FIG. 3, the trigger 151 is provided on the front side of an upper end portion of the handle 15. A switch 152 is housed in the inside of the handle 15 behind the trigger 151. The switch 152 is configured to be switched between an on-state and an off-state according to a depressing operation of the trigger 151. The switch 152 is connected to the controller 154 to be described later via wiring (not shown) and is configured to output a signal corresponding to the on-state or off-state to the controller 154.

A lower end portion of the handle 15 has a rectangular box-like shape and forms a controller housing part 153. A first board (main board) 155 is housed in the controller housing part 153. On the first board 155 are mounted the controller 154 configured to control operations of the fastening tool 1, an input-accepting part 156, a three-phase inverter 201 and a current-detecting amplifier 205, which will be described later. In the present embodiment, the controller 154 is configured as a microcomputer including a CPU, a ROM, a RAM, a nonvolatile memory (EEPROM) and a timer.

Figure 8:
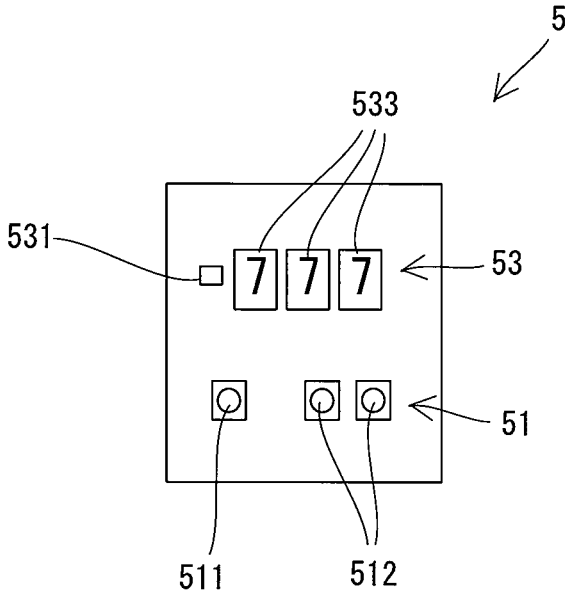
FIG. 8 is a diagrammatic view showing an external appearance of an operation/display part.

An operation/display part 5 is provided on a top of the controller housing part 153. As shown in FIG. 8, the operation/display part 5 includes an operation part 51 and a display part 53. Various setting information can be inputted into the operation part 51 in response to a user's external operation. The display part 53 is configured to display various information.

In the present embodiment, the operation part 51 includes a first switch 511 and two second switches 512. The first switch 511 is provided for switching an operation mode of the fastening tool 1 and for setting a control condition of the motor 2. The second switches 512 are provided for setting the control condition of the motor 2. It is noted that the first and second switches 511 and 512 are each configured as a push switch. More specifically, the first and second switches 511 and 512 are each configured as a push-button momentary switch (so-called tactile switch) which is normally kept in the off-state and turned to the on-state only while being pressed. The first and second switches 511 and 512 are each connected to the input-accepting part 156 via wiring (not shown) and configured to output a digital signal corresponding to the on-state or off-state to the input-accepting part 156.

In the present embodiment, the fastening tool 1 has two kinds of operation modes, that is, a setting mode in which the control condition of the motor 2 can be set, and a work mode for performing a fastening operation. The user can switch the operation mode of the fastening tool 1 between the setting mode and the work mode by a long-pressing operation (a continuous pressing operation for a specified time) of the first switch 511. Further, in the fastening tool 1 configured as a common-type device, it is necessary to control driving of the motor 2 (or the operation of the driving mechanism 4) according to the kind of the fastener to be used. Therefore, the fastening tool 1 has two kinds of control modes, that is, a first control mode for the tear-off type fastener, and a second control mode for the shaft-retaining type fastener. When the setting mode is selected as the operation mode of the fastening tool 1, the user can switch the control mode of the motor 2 between the first control mode and the second control mode by a normal-pressing operation (pressing for a shorter time than the long-pressing operation) of the first switch 511. It is noted here that the control mode of the motor 2 is an example of the control condition of the motor 2.

Further, the user can input setting information for a control condition of the motor 2 other than the control mode of the motor 2, by operating the two second switches 512. In the present embodiment, a three-digit numerical value can be inputted with the second switches 512. One of the two second switches 512 is for inputting (or changing) numerical values ranging from 0 to 9 for each digit, and the other is for selecting (or changing) the place of the digit (which digit of the three-digit numerical value to be inputted).

In the present embodiment, the initial position of the pin-gripping part 63A in the front-rear direction is adopted as a control condition of the motor 2 in the first control mode. Further, a threshold for the pulling force of the pin-gripping part 63B pulling the shaft part 811 is adopted as a control condition of the motor 2 in the second control mode.

More specifically, when the setting mode is selected as the operation mode of the fastening tool 1 and the first control mode is selected as the control mode of the motor 2, a value for adjusting the currently set initial position in the front-rear direction can be inputted as the setting information for the initial position of the pin-gripping part 63A, by operating the second switches 512.

The initial position may be adjusted to optimize the gripping force of the jaw 65 in the initial position. As described above, in the present embodiment, the initial position of the screw shaft 46 (the driving shaft 460) (that is, the initial position of the pin-gripping part 63A) needs to be set to a position where the claws 651 of the jaw 65 can appropriately grip the pin 81. Specifically, is may be preferable that the initial position is set to a position where the pintail 813 can be inserted into the jaw 65 and where the claws 651 can lightly grip the pintail 813 inserted into the jaw 65 with a gripping force which is strong enough to prevent the fastener 8 from slipping out of the nose part 6 by its own weight. At the time of factory shipment, the initial position is set to an appropriate position. However, the gripping force of the jaw 65 in the initial position set at the time of factory shipment may be changed with time, due to wear or a displacement of the anvil 61 and the pin-gripping part 63A (the jaw case 64 or the jaw 65), for example. Consequently, the jaw 65 may no longer be able to appropriately grip the pin 81. Further, the gripping force a user feels appropriate may be slightly different from user to user. Therefore, in the present embodiment, the fastening tool 1 is configured such that the initial position of the pin-gripping part 63A can be adjusted.

In the present embodiment, the initial position may be adjusted by adjusting a period of time (hereinafter referred to as a braking-standby time) from when the magnet 486 is detected by the above-described first sensor 481 until when braking of the motor 2 is started. Therefore, an adjustment value for the braking-standby time (a value to be added to or to be subtracted from the currently set braking-standby time) may be inputted as the setting information for the initial position via the second switches 512. By adjusting the braking-standby time, the distance of the forward movement of the screw shaft 46 and the pin-gripping part 63A after the magnet 486 is detected by the first sensor 481 can be adjusted, or in other words, the initial position can be adjusted.

When the setting mode is selected as the operation mode of the fastening tool 1 and the second control mode is selected as the control mode of the motor 2, a value for adjusting the currently set threshold of the pulling force can be inputted by operating the second switches 512.

The threshold of the pulling force may be adjusted in order to set an appropriate timing of completing swaging of the fastener 9, or in other words, of stopping the rearward movement of the pin-gripping part 63B. As described above, in the operation of fastening the workpieces W with the fastener 9, the shaft part 911 of the pin 91 needs to be returned forward while being gripped by the pin-gripping part 63B without being torn off after the collar 95 is swaged onto the shaft part 911. Accordingly, the rearward movement of the pin-gripping part 63B needs to be stopped when the force of the pin-gripping part 63B pulling the shaft part 911 exceeds a threshold of an appropriate pulling force which is strong enough to reliably swage the collar 95 onto the shaft part 911 without breaking the shaft part 911 and damaging the collar 95 or the fastening tool 1. Even when the same fastener 9 is used, the appropriate pulling force may vary, for example, depending on the material and specifications of the workpieces W. Therefore, in the present embodiment, the fastening tool 1 is configured such that the threshold of the pulling force can be adjusted.

As a relative axial force, that is, a pulling force acting on the pin 91 and the collar 95 increases with progress of the swaging operation, a load on the motor 2 increases. In the present embodiment, based on this correlation, the threshold of the pulling force may be adjusted by adjusting a threshold of the driving current, which is an example of a physical quantity indicating a load on the motor 2. Therefore, an adjustment value for the threshold of the driving current of the motor 2 (a value to be added to or to be subtracted from the currently set threshold of the driving current) may be inputted via the second switches 512 as the setting information for the threshold of the pulling force. By adjusting the threshold of the driving current, the threshold (upper limit) of the pulling force can be adjusted.

The display part 53 is configured to display the setting information for the control condition of the motor 2 and other information which are inputted via the operation part 51. In the present embodiment, the display part 53 includes a light emitting diode (LED) lamp 531 and three seven-segment LEDs 533. The LED lamp 531 is provided to inform the user of the selected operation mode. The LED lamp 531 is configured to be lit when the operation mode of the fastening tool 1 is the setting mode. The seven-segment LEDs 533 are provided to indicate the control mode of the motor 2 and the setting information for the control condition which is inputted through the operation part 51 by the user (or the control condition itself). Each of the LEDs 533 is configured to display numerical values and specified characters.

In the present embodiment, the operation part 51 (the first switch 511 and the second switches 512) and the display part 53 (the LED lamp 531 and the seven-segment LEDs 533) are mounted on a second board 50 which is different from the first board 155 and disposed above the controller 154 within the controller housing part 153. With the arrangement that the operation part 51 and the display part 53 are mounted on the second board 50 which is different from the first board 155 on which the controller 154 is mounted, the degree of freedom in the arrangement of the operation part 51 and the display part 53 can be improved.

An electric configuration of the fastening tool 1 is now described.

Figure 9:
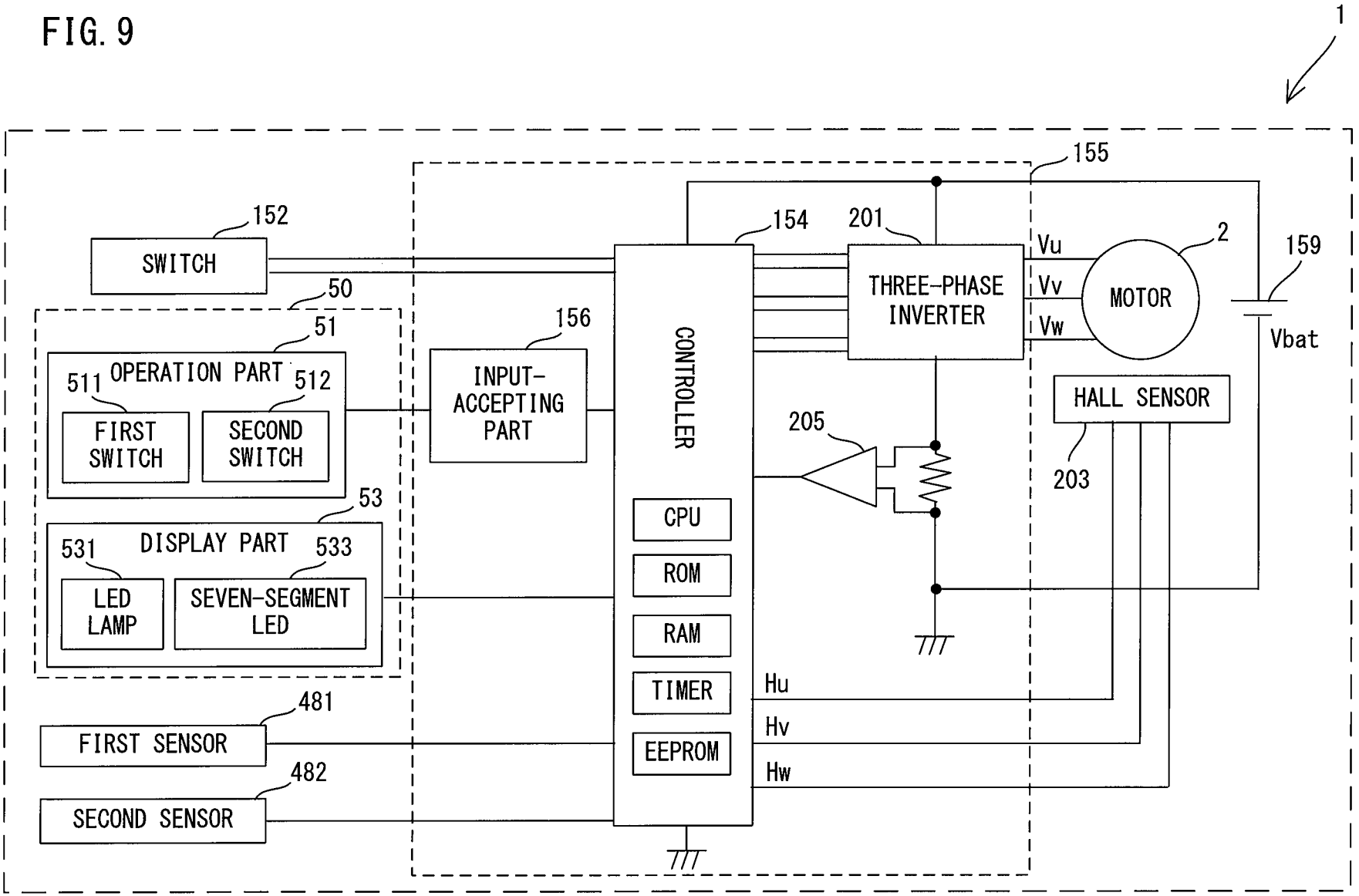
FIG. 9 is a block diagram showing an electric configuration of the fastening tool.

As shown in FIG. 9, the three-phase inverter 201 and a Hall sensor 203 are electrically connected to the controller 154. In the present embodiment, the three-phase inverter 201 has a three-phase bridge circuit using six semiconductor switching elements. The three-phase inverter 201 is configured to perform a switching operation of each switching element of the three-phase bridge circuit, according to a duty ratio indicated by a control signal from the controller 154 and thereby supplies a pulsed electric current (driving pulse) corresponding to the duty ratio. The Hall sensor 203 includes three Hall elements which are disposed corresponding to three phases of the motor 2, respectively, and is configured to output a signal indicating the rotation angle of the rotor 23. The controller 154 is configured to control rotation speed of the motor 2 by controlling energization to the motor 2 via the three-phase inverter 201 based on a signal inputted from the Hall sensor 203. Further, the rotation speed of the motor 2 is PWM-controlled.

The current-detecting amplifier 205 is also electrically connected to the controller 154. The current-detecting amplifier 205 is configured to convert the driving current of the motor 2 into voltage by a shunt resistor and output a signal amplified by the amplifier to the controller 154. When the second control mode is selected as the control mode of the motor 2, the controller 154 controls driving of the motor 2 based on the threshold which is set based on the setting information inputted via the operation part 51 and the detected driving current, which will be described in detail later.

Furthermore, the switch 152 of the trigger 151, the input-accepting part 156, the display part 53 (the LED lamp 531 and the seven-segment LEDs 533), the first sensor 481 and the second sensor 482 are electrically connected to the controller 154. Further, the operation part 51 (the first switch 511 and the second switches 512) is electrically connected to the input-accepting part 156. The input-accepting part 156 is configured to accept input of the setting information relating to the operation mode of the fastening tool 1 and the control condition of the motor 2 (the control mode of the motor 2, the braking-standby time and the threshold of the driving current) via the operation part 51 and to output a corresponding signal to the controller 154. When the operation mode is the work mode, however, the input-accepting part 156 does not output any signal to the controller 154, even if the setting information is inputted. In other words, when the work mode is selected, the input-accepting part 156 does not accept the setting information, and a normal pressing operation of the first switch 511 (switching of the control mode) and a pressing operation of the second switch 512 (adjustment of the braking-standby time and the threshold) are made as invalid.

The controller 154 (specifically, CPU) is configured to receive signals outputted from the switch 152, the input-accepting part 156, the first sensor 481 and the second sensor 482, and to appropriately control driving of the motor 2 (the operation of the driving mechanism 4) based on these signals.

For example, when recognizing that the switch 152 is turned on, the controller 154 starts normal rotation driving of the motor 2 by starting energization via the three-phase inverter 201. The normal rotation driving refers to a driving manner in which the motor shaft 25 rotates in a direction to move the screw shaft 46 rearward. Further, when recognizing that the switch 152 is turned off, the controller 154 starts reverse rotation driving of the motor 2. The reverse rotation driving refers to a driving manner in which the motor shaft 25 rotates in a direction to move the screw shaft 46 forward.

In the present embodiment, in an initial setting process after power-up of the fastening tool 1, the controller 154 reads out the setting information for the operation mode and the control condition of the motor 2 (the control mode, the braking-standby time and the adjustment value of the threshold) from the nonvolatile memory to the RAM, and uses the readout in subsequent processing. Each time the controller 154 receives new setting information for the operation mode or the control condition in the subsequent processing, the controller 154 overwrites the information of the RAM and executes the processing, while storing the latest setting information in the nonvolatile memory. Thus, the latest setting information inputted via the operation part 51 is stored in the nonvolatile memory.

The controller 154 sets the operation mode of the fastening tool 1 and the control condition of the motor 2 (the control mode of the motor 2, the braking-standby time and the threshold of the driving current) based on signals outputted from the input-accepting part 156.

Specifically, when the input-accepting part 156 accepts the setting information of the operation mode inputted by a long-pressing operation of the first switch 511, the controller 154 changes the operation mode (the setting mode or work mode). When the input-accepting part 156 accepts the setting information for the control mode of the motor 2 which is inputted by the normal-pressing operation of the first switch 511, the controller 154 changes the control mode (the first or second control mode). When the input-accepting part 156 accepts the setting information for the control condition which is inputted by pressing the second switch (es) 512, the controller 154 executes the following processing. When the current control mode (the control mode stored in the RAM) is the first control mode, the controller 154 changes the braking-standby time based on the adjustment value of the braking-standby time accepted by the input-accepting part 156. When the current control mode is the second control mode, the controller 154 changes the threshold of the driving current based on the adjustment value of the threshold accepted by the input-accepting part 156.

Further, the controller 154 controls the display (specifically, turning on and off of the LED lamp 531 and the seven-segment LEDs 533) of the display part 53 based on a signal outputted from the input-accepting part 156.

Specifically, when the work mode is set as the operation mode, the controller 154 turns off the LED lamp 531. Further, when the current control mode is the first control mode, the controller 154 displays the current adjustment value of the braking-standby time (or the braking-standby time itself) on the seven-segment LEDs 533. When the current control mode is the second control mode, the controller 154 displays the current adjustment value of the threshold of the driving current (or the threshold of the driving current itself) on the seven-segment LEDs 533. Further, as described above, the control mode and the control condition are not changed during the work mode, so that the display of the seven-segment LEDs 533 is not changed. When the controller 154 recognizes any error (for example, a malfunction of the first sensor 481 or the second sensor 482) which has occurred in the fastening tool 1 during the work mode, the controller 154 displays specific characters (error code) indicating the error on the seven-segment LEDs 533.

When the setting mode is set as the operation mode, the controller 154 lights the LED lamp 531. Further, when the current control mode is the first control mode and an adjustment value of the braking-standby time is inputted, the controller 154 displays this adjustment value (or the braking-standby time after adjustment based on this adjustment value) on the seven-segment LEDs 533. When the current control mode is the second control mode and an adjustment value of the threshold of the driving current is inputted, the controller 154 displays this adjustment value (or the threshold of the driving current after adjustment based on this adjustment value) on the seven-segment LEDs 533. Further, in the present embodiment, a numerical value to be displayed on the seven-segment LEDs 533 is made different in the number of digits, depending on which one of the first and second control modes is currently selected. With this difference in the display, the user is informed of which of the first and second control modes is currently selected.

The processes of fastening the workpieces W by the fastening tool 1 respectively using the tear-off type fastener 8 and the shaft-retaining type fastener 9 are now described in this order.

First, a fastening process using the fastener 8 is described. A user first mounts the nose part 6A (see FIG. 6) for the fastener 8 to the housing 10. Further, the user checks the display of the seven-segment LEDs 533 and then inputs setting information by operating the operation part 51 as necessary. The controller 154 operates as described above. Further, in an initial state in which the trigger 151 is not yet depressed, the screw shaft 46 is held in a state as it was returned to the initial position in the last fastening process.

When the trigger 151 is depressed and the switch 152 is turned on, the controller 154 starts normal rotation driving of the motor 2. Even when the setting mode is selected as the operation mode, as well as when the work mode is selected, the controller 154 drives the motor 2, without treating the operation of the trigger 151 as invalid and drives the motor 2.

When the screw shaft 46 and the pin-gripping part 63A are moved rearward from the initial position by the normal rotation driving of the motor 2, the pin 81 is firmly gripped and pulled rearward by the jaw 65. The fastening tool 1 breaks the pin 81 and separates the pintail 813 gripped by the jaw 65 while fastening the workpieces W with the fastener 8, before the screw shaft 46 is moved to a position where the magnet 486 enters the detection range of the second sensor 482. Thereafter, the screw shaft 46 and the pin-gripping part 63A are further moved rearward with the separated pintail 813 being gripped by the jaw 65. Upon recognizing a detection signal from the second sensor 482, the controller 154 brakes the motor 2. In the present embodiment, the motor 2 is braked by stopping the driving of the motor 2, but may be braked, for example, by applying torque in a reverse direction to the motor 2 for a certain period of time or power transmission from the motor 2 to the nut 41 may be interrupted. As a result, the screw shaft 46 and the pin-gripping part 63B are decelerated and stopped.

When the operation of depressing the trigger 151 by the user is released and the switch 152 is turned off, the controller 154 starts reverse rotation driving of the motor 2. The screw shaft 46 and the pin-gripping part 63A are moved forward with the separated pintail 813 being gripped by the jaw 65. When the screw shaft 46 is moved up to a position where the magnet 486 enters the detection range of the first sensor 481, the controller 154 recognizes a detection signal from the first sensor 481 and then starts measuring an elapsed time by the timer. The controller 154 continues the reverse rotation driving of the motor 2 until the braking-standby time stored in the RAM elapses. Thus, the screw shaft 46 is further moved forward by a distance corresponding to the braking-standby time.

When the braking-standby time elapses, the controller 154 brakes the motor 2. As a result, the screw shaft 46 and the pin-gripping part 63A are decelerated and stopped in the initial position, and thus one cycle of the fastening process is completed. The pintail 813 can be released from the jaw 65 at this time. In the next cycle of fastening process, when pushed rearward by a pintail 813 of another fastener 8, the released pintail 813 is passed through the passage 70 and stored in the container 7.

Next, a fastening process using the fastener 9 is described. A user first mounts the nose part 6B (see FIG. 7) for the fastener 9 to the housing 10. Further, the user checks the display of the seven-segment LEDs 533 and then inputs setting information by operating the operation part 51 as necessary. The controller 154 operates as described above.

When the trigger 151 is depressed and the switch 152 is turned on, the controller 154 starts normal rotation driving of the motor 2. The screw shaft 46 and the pin-gripping part 63B are moved rearward from the initial position, so that the pin 91 is firmly gripped by the jaw 630 and pulled rearward. Upon determining that the driving current of the motor 2 exceeds the threshold, based on a signal from the current-detecting amplifier 205 and the threshold stored in the RAM, the controller 154 brakes the motor 2. As a result, the screw shaft 46 and the pin-gripping part 63B are decelerated and stopped.

When the operation of depressing the trigger 151 by the user is released and the switch 152 is turned off, the controller 154 starts reverse rotation driving of the motor 2. The screw shaft 46 and the pin-gripping part 63B are moved forward while the pin 91 onto which the collar 95 has been swaged is gripped by the jaw 630. When the screw shaft 46 is moved up to a position where the magnet 486 enters the detection range of the first sensor 481, the controller 154 recognizes a detection signal from the first sensor 481 and then brakes the motor 2. As a result, the screw shaft 46 and the pin-gripping part 63B are decelerated and stopped in the initial position, and thus one cycle of the fastening process is completed.

As described above, in the present embodiment, the input-accepting part 156 is configured to accept the setting information for the control condition of the motor 2 (the control mode, the threshold of the pulling force, or the initial position of the pin-gripping part 63A) which is inputted via the operation part 51 by a user's external operation. The controller 154 is configured to set the control condition based on the setting information accepted by the input-accepting part 156 and to control driving of the motor 2 to thereby control operation of the driving mechanism 4. In other words, the controller 154 is capable of controlling driving of the motor 2 and thus the operation of the driving mechanism 4, not according to a fixed control condition but to a control condition changed according to the setting information accepted by the input-accepting part 156. Further, the user can input appropriate setting information according to working conditions of the fastening tool 1 via the operation part 51. Therefore, appropriate control can be realized according to the working conditions of the fastening tool 1.

Particularly, in the present embodiment, the operation part 51 is provided on the fastening tool 1, so that the user can perform both the setting of the control conditions of the motor 2 and the fastening operation with one device, that is, the fastening tool 1. Therefore, the user need not operate an external device different from the fastening tool 1 in order to input the setting information, so that convenience and operability can be improved. Further, the operation part 51 is configured as a push switch which is configured to output the setting information as a digital signal. Therefore, compared with a case employing a dial type operation part which is configured to output an analog signal, fine operation can be facilitated. Further, the risk of changing the control condition by an unintentional operation can be reduced.

The fastening tool 1 of the present embodiment is configured to be used with both of the tear-off type fastener 8 and the shaft-retaining multi-piece swage type fastener 9. In use of the fastener 8, the controller 154 is capable of changing the initial position of the pin-gripping part 63A based on the setting information for the initial position of the pin-gripping part 63A which is inputted via the operation part 51. Thus, for example, even when the anvil 61A or the pin-gripping part 63A is worn, the pin-gripping part 63A can be placed in the initial position where the pin-gripping part 63A can grip the pin 91 with an appropriate gripping force. Further, in use of the fastener 9, the controller 154 is capable of changing the threshold of the pulling force of the pin-gripping part 63B based on the setting information for the threshold of the pulling force which is inputted via the operation part 51. Therefore, the controller 154 can terminate the rearward movement of the pin-gripping part 63B at the point when an appropriate pulling force is applied which is strong enough to reliably swage the collar 95 onto the shaft part 911 without breaking the shaft part 911 or damaging the collar 95 or the fastening tool 1, according to the material and specifications of the workpieces W, for example.

In the present embodiment, the fastening tool 1 is provided with the display part 53 configured to display the setting information (or control condition based on the setting information). Therefore, the user can check whether or not an appropriate control condition is set, looking at the displayed setting information (or control condition based on the setting information). Accordingly, the user can change the setting of the control condition by operating the operation part 51, as necessary. Further, in addition to the setting information, information relating to an error (error code), which is useful to the user, is displayed on the display part 53, which can improve convenience.

In the present embodiment, the fastening tool 1 is configured to operate in the setting mode, in which the input-accepting part 156 is capable of accepting input of the setting information, and the work mode, in which the input-accepting part 156 does not accept input of the setting information. Switching from the work mode to the setting mode can be performed by a specific operation (specifically, a long-pressing operation of the first switch 511) which is different from the operation of inputting the setting information into the operation part 51 (specifically, a normal-pressing operation of the first switch 511 and a pressing operation of the second switches 512). Therefore, when the operation mode of the fastening tool 1 is set to the work mode, the user can be prevented from unintentionally inputting setting information due to an erroneous operation of the operation part 51.

In the present embodiment, the setting information which is inputted via the operation part 51 and accepted by the input-accepting part 156 is stored in the nonvolatile memory of the controller 154. Further, the controller 154 (CPU) can control driving of the motor 2 according to the control condition based on the setting information stored in the nonvolatile memory. Therefore, the setting information set via the operation part 51 by a user in the past can be effectively utilized in the fastening operation. It is noted that the control condition which has been changed based on the setting information may be stored, in place of the setting information, in the nonvolatile memory.

The above-described embodiment is a mere example and the fastening tool according to the present invention is not limited to the structure of the fastening tool 1 of the embodiment. For example, the following modifications may be made. One or more of these modifications may be employed independently, or in combination with the fastening tool 1 of the above-described embodiment or the claimed invention.

For example, in the above-described embodiment, the fastening tool 1 is configured such that it can be used with both of tear-off type fasteners and shaft-retaining type fasteners by replacing the nose part 6. However, the fastening tool 1 may be configured as a dedicated-type device which is designed specifically for the tear-off type fasteners or for the shaft-retaining type fasteners.

The structures of the motor 2, the transmitting mechanism 3 and the driving mechanism 4 may be appropriately changed. For example, the motor 2 may be a motor with a brush or an alternate current (AC) motor. The number of the planetary gear mechanisms of the planetary gear reducer 31 and arrangement of the intermediate shaft 33 may be changed. Further, as the driving mechanism 4, for example, in place of the ball-screw mechanism 40 having the nut 41 and the screw shaft 46 engaged with the nut 41 via the balls, a feed-screw mechanism may be employed. The feed-screw mechanism includes a nut having a female thread formed in its inner periphery and a screw shaft having a male thread formed in its outer periphery and threadedly engaged directly with the nut. Further, the ball-screw mechanism 40 may be configured such that the screw shaft 46 is rotatably supported while a movement of the screw shaft 46 in the front-rear direction is restricted, while the nut 41 is movable in the front-rear direction along with rotation of the screw shaft 46. In this case, the pin-gripping part 63 may be directly or indirectly connected to the nut 41.

The structures of the anvils 61A and 61B, and the pin-gripping parts 63A and 63B of the nose part 6 may be appropriately changed. For example, the shape of the anvil 61A or 61B and the manner of connecting the anvil 61A or 61B to the housing 10 may be changed. As for the pin-gripping part 63A, it only needs to be configured such that its gripping force of gripping the pin 81 is changed as the jaw 65 (the claws 651) moves radially along with the movement of the pin-gripping part 63A in the front-rear direction relative to the anvil 61A. Therefore, for example, the shapes of the jaw case 64 and the claws 651, the structures of the spring holding members 67 or the manner of connecting the pin-gripping part 63A to the screw shaft 46 may be appropriately changed. Similarly, as for the pin-gripping part 63B, the shapes and the structures of the jaw 630 (the claws 631) and the base part 632 or the manner of connecting the pin-gripping part 63B to the screw shaft 46 may be appropriately changed.

In the above-described embodiment, a magnetic field detection-type sensor is employed as each of the first and second sensors 481 and 482. In place of this type, a sensor of a different type (for example, an optical sensor such as a photo interrupter) or a mechanical switch may be used. Further, in place of the first and second sensors 481 and 482, a single sensor or switch may be employed. For example, a single sensor or switch may be employed which is capable of detecting that the screw shaft 46 (the driving shaft 460) and the pin-gripping part 63 are located at a specified home position, which is different from the initial position or the rearward stop position in the front-rear direction. In this case, the controller 154 may stop driving of the motor 2 based on the number of revolutions of the motor 2 or the number of driving pulses which are counted after detection of the screw shaft 46 located at the home position, so that the screw shaft 46 (the driving shaft 460) and the pin-gripping part 63 are placed in the specified initial position or stop position. The number of revolutions of the motor 2 may be detected, for example, by a Hall sensor.

The operation/display part 5 includes the operation part 51 having the first switch 511 and the second switches 512 and the display part 53 having the LED lamp 531 and the seven-segment LEDs 533, but the structures of the operation part 51 and the display part 53 may be appropriately changed. For example, the operation/display part 5 may be configured as a touch panel. Further, the operation part 51 and the display part 53 do not need to be integrated with each other. The operation part 51 and the display part 53 may be separately provided in different positions of the fastening tool 1. In this case, it may be preferable that at least one of the operation part 51 and the display part 53 is mounted on a different board from the first board (main board) 155, like in the above-described embodiment.

Figure 10:
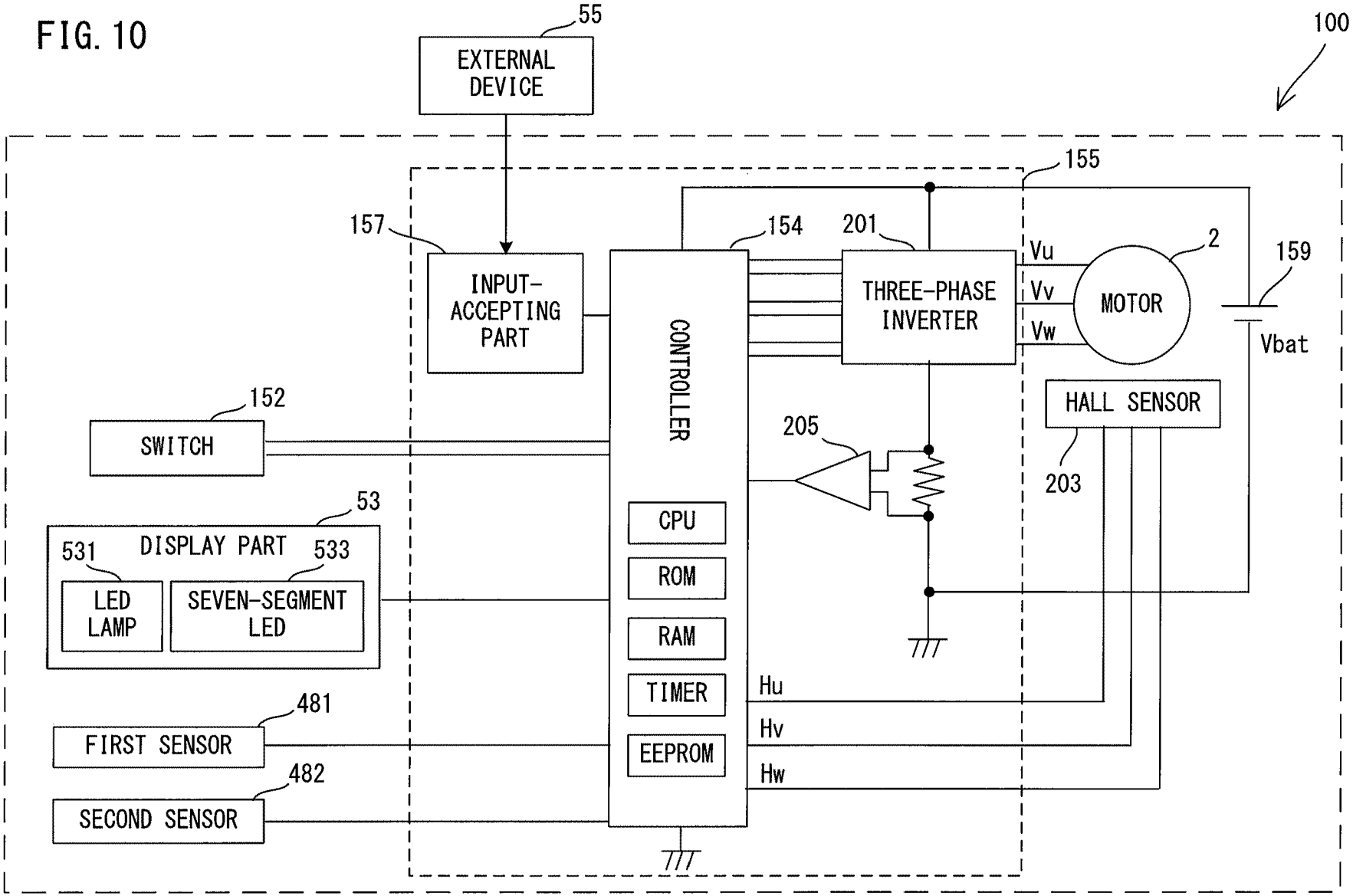
FIG. 10 is a block diagram showing an electric configuration of the fastening tool according to a modification.

Further, the operation part 51 does not need to be provided in the fastening tool 1. For example, in a fastening tool 100 of a modification shown in FIG. 10, an input-accepting part 157 is configured to include a communication interface capable of communicating by wire or wireless means with an external device (for example, a portable terminal) 200, which is configured to be externally operated by a user. In this case, the input-accepting part 157 is configured to accept the transmitted setting information which is inputted into the external device 55 by a user's operation.

The setting information for the control condition of the motor 2 to be inputted via the operation part 51 and the external device 55 is not limited to those of the above-described embodiment (the control mode of the motor 2, the setting information for the initial position and the threshold of the pulling force). Setting information for another control condition may be inputted which needs to be adjusted according to the kind of the fastener to be used. Further, the setting information for the initial position need not be an adjustment value of the braking-standby time, but may be the braking-standby time itself. Other examples of the setting information for the initial position which can be employed may include the number of driving pulses to be supplied to the motor 2 or the rotation angle (the number of revolutions) of the motor 2, during the time from when the magnet 486 is detected until when braking of the motor 2 is started. The setting information for the threshold of the pulling force need not be an adjustment value of the threshold of the driving current, but may be the threshold of the driving current itself. Further, as the setting information for the threshold of the pulling force, for example, a threshold of an internal resistance value or a threshold of a voltage drop value of the battery 159 may also be employed.

Information to be displayed in the display part 53 is not limited to those of the above-described embodiment. For example, the information to be displayed in the work mode other than the setting information may be information not relating to an error. For example, a temperature sensor may be provided in the fastening tool 1, and an outside air temperature may be displayed on the display part 53. In this case, when fastening workpieces formed of a material (such as aluminum) whose properties are liable to change according to an outside air temperature, a user can check the outside air temperature and appropriately adjust the threshold of the pulling force via the operation part 51. Further, a use history of the fastening tool 1 may be displayed. For example, the number of times of detection of the magnet 486 by the first sensor 481 may be displayed as the number of fasteners which have been fastened by the fastening tool 1

In the above-described embodiment, the input-accepting part 156 is configured as a different control circuit from the controller 154, but signals from the operation part 51 (the first switch 511 and the second switches 512) may be directly inputted into the controller 154. In other words, the controller 154 may perform a function as an input-accepting part which accepts input of the setting information from the operation part 51.

In the above-described embodiment, each time when the input-accepting part 156 accepts the setting information, the latest setting information is stored in the nonvolatile memory and used in the subsequent processing. However, the setting information does not need to be stored in the nonvolatile memory. Further, only when an instruction for storing the setting information is inputted via the operation part 51, the controller 154 may store the setting information in the nonvolatile memory. Plural kinds of the setting information may be stored. In this case, the controller 154 may read out from the nonvolatile memory the setting information which is specified via a pressing operation of a specific switch of the operation part 51, and use the readout in subsequent processing. In this case, a user can store the setting information for a desired control condition and to press the specific switch as necessary, thereby saving the trouble of setting work.

In the above-described embodiment, the operation mode of the fastening tool 1 is switched from the work mode to the setting mode in response to the long-pressing operation of the first switch 511. It may be configured such that switching from the work mode to the setting mode can be performed only by a special operation other than the long-pressing operation, in order to make it more difficult to switch to the setting mode. For example, an operation of simultaneously pressing the first switch 511 and the trigger 151, or a switching operation of a switch which cannot be operated unless a mechanical lock is released may be employed as the special operation. In such a case, a user can be reliably prevented from unintentionally switching to the setting mode, and only a person (for example, a work manager) who knows the special operation is allowed to input the setting information. Further, only the setting mode may be provided as the operation mode of the fastening tool 1. When plural operation modes are provided, not only the setting mode and the work mode but also other modes may be provided.

In the above-described embodiment and modification, the controller 154 is formed by a microcomputer including a CPU, a ROM and a RAM. The controller (control circuit), however, may be formed, for example, by a programmable logic device such as an ASIC (Application Specific Integrated Circuit) and an FPGA (Field Programmable Gate Array).

Correspondences between the features of the above-described embodiment and its modifications and the features of the invention are as follow. Each of the fasteners 8 and 9 is an example that corresponds to the "fastener" according to the present invention. Each of the pins 81 and 91 is an example that corresponds to the "pin" according to the present invention. Each of the body 85 and the collar 95 is an example that corresponds to the "cylindrical part" according to the present invention. The fastener 9 is an example that corresponds to the "shaft-retaining multi-piece swage type fastener" according to the present invention. The shaft part 911 and the head 915 are examples that correspond to the "shaft part having no small-diameter part for breakage" and the "head", respectively, according to the present invention. The fastener 8 is an example that corresponds to the "tear-off type fastener" according to the present invention. The shaft part 811 and the small-diameter part 812 are examples that correspond to the "shaft part" and the "small-diameter part for breakage", respectively, according to the present invention. The workpiece W is an example that corresponds to the "workpiece" according to the present invention.

The fastening tool 1 is an example that corresponds to the "fastening tool" according to the present invention. The driving axis A1 is an example that corresponds to the "driving axis" according to the present invention. Each of the anvils 61A and 61B is an example that corresponds to the "fastener-abutment part" according to the present invention. Each of the pin-gripping parts 63A and 63B is an example that corresponds to the "pin-gripping part" according to the present invention. The motor 2 is an example that corresponds to the "motor" according to the present invention. The driving mechanism 4 is an example that corresponds to the "driving mechanism" according to the present invention. Each of the operation part 51 and the external device 55 is an example that corresponds to the "operation part" according to the present invention. Each of the input-accepting part 156 and the controller 154 (CPU) of the modification is an example that corresponds to the "input-accepting part" according to the present invention. The controller 154 (CPU) is an example that corresponds to the "motor-control part" according to the present invention. The display part 53 is an example that corresponds to the "display part" according to the present invention. The nonvolatile memory of the controller 154 is an example that corresponds to the "storage device" according to the present invention.

Each of the control mode of the motor 2, the threshold of the pulling force, and the initial position of the pin-gripping part 63 is an example that corresponds to the "control condition of the motor" according to the present invention. The error code is an example that corresponds to the "information other than the setting information" according to the present invention. The setting mode is an example that corresponds to the "input-accepting mode" according to the present invention. The work mode is an example that corresponds to the "mode different from the input-accepting mode" according to the present invention.

Further, in view of the nature of the present invention, the above-described embodiment and its modifications, the following features are provided. The following features may be employed in combination with any one of the fastening tool 1 of the embodiment, the above-described modifications and the claimed invention.

(Aspect 1)

The fastening tool may further comprise:

a to-be-detected part provided to move together with the pin-gripping part in the front-rear direction; and a detecting device configured to detect the to-be-detected part when the pin-gripping part is placed in a specified detection position in the front-rear direction, and setting information for the initial position may be setting information for a braking-standby time, the braking-standby time being a period of time from when the to-be-detected part is detected by the detecting device until when the motor-control part brakes the motor.

(Aspect 2)

Setting information for the threshold of the pulling force may be setting information for a threshold of driving current of the motor.

(Aspect 3)

In aspect 2, the fastening tool may further comprise:

a current-detecting part configured to detect the driving current of the motor, and the motor-control part may be configured to control operation of the driving mechanism to terminate a rearward relative movement of the pin-gripping part when the motor driving current detected by the current-detecting part exceeds the threshold of the driving current, and to move forward the pin-gripping part gripping the shaft part with the cylindrical part swaged thereto, relative to the fastener-abutment part.

DESCRIPTION OF THE NUMERALS

1, 100: fastening tool, 10: housing, 11: outer housing, 111: roller guide, 113: container connection part, 114: opening, 117: guide sleeve, 13: inner housing, 14: nose-holding member, 141: locking part, 145: fixing ring, 15: handle, 151: trigger, 152: switch, 153: controller housing part, 154: controller, 155: first board, 156, 157: input-accepting part, 158: battery-mounting part, 159: battery, 2: motor, 20: motor body, 21: stator, 23: rotor, 25: motor shaft, 27: fan, 201: three-phase inverter, 203: Hall sensor, 205: current-detecting amplifier, 3: transmitting mechanism, 30: reduction gear housing, 31: planetary gear reducer, 311: sun gear, 313: carrier, 33: intermediate shaft, 35: nut-driving gear, 4: driving mechanism, 40: ball-screw mechanism, 41: nut, 411: driven gear, 412: radial bearing, 413: radial bearing, 46: screw shaft, 460: driving shaft, 461: through hole, 463: roller-holding part, 464: roller, 47: extension shaft, 48: position-detecting mechanism, 481: first sensor, 482: second sensor, 485: magnet-holding part, 486: magnet, 49: connecting member, 495: through hole, 5: operation/display part, 50: second board, 51: operation part, 511: first switch, 512: second switch. 53: display part, 531: LED lamp, 533: seven-segment LED, 55: external device, 6, 6A, 6B: nose part, 61, 61A, 61B: anvil, 611: sleeve, 612: locking rib, 614: nose tip, 615: insertion hole, 617: tapered part, 63, 63A, 63B: pin-gripping part, 630, 65: jaw, 631, 651: claw, 632: base part, 64: jaw case, 641: connecting member, 66: biasing spring, 67: spring holding member, 671: first member, 672: sliding part, 675: second member, 7: container, 70: passage, 8, 9: fastener, 81, 91: pin, 811, 911: shaft part, 812: small-diameter part, 813: pintail, 815, 915: head, 85: body, 851: sleeve, 853: flange, 95: collar, 951: flange, 953: engagement part, A1: driving axis, A2: rotation axis, W: workpiece

The invention claimed is:

1. A fastening tool configured to fasten a workpiece via a fastener, the fastener having a pin and a cylindrical part, the fastening tool comprising:

a fastener-abutment part configured to abut on the cylindrical part;

a pin-gripping part disposed to be movable along a driving axis relative to the fastener-abutment part and configured to grip a portion of the pin, the driving axis extending in a front-rear direction of the fastening tool;

a motor;

a driving mechanism configured to be driven by power of the motor to move the pin-gripping part rearward along the driving axis relative to the fastener-abutment part, thereby fastening the workpiece via the fastener;

an input-accepting part configured to accept setting information for a control condition of the motor, the setting information being inputted via an operation part configured to be externally operated by a user; and a motor-control part configured to control operation of the driving mechanism by controlling driving of the motor according to the control condition based on the setting information accepted by the input-accepting part, wherein the fastening tool is configured to use, as the fastener, a shaft-retaining multi-piece swage type fastener, in which the pin and the cylindrical part are formed separately from each other, the pin includes a shaft part and a head, the shaft part having no small-diameter part for breakage, the head being formed on one end of the shaft part, the cylindrical part having a hollow cylindrical shape engageable with the shaft part, the input-accepting part is configured to accept, as the setting information, setting information for a threshold of a pulling force of the pin-gripping part pulling the shaft part, the motor-control part is configured to control operation of the driving mechanism to move the pin-gripping part gripping the shaft part rearward relative to the fastener-abutment part such that the fastener-abutment part presses the cylindrical part engaged with the shaft part in an axial direction and radially inward, thereby swaging the cylindrical part onto the shaft part and thus fastening the workpiece between the head and the cylindrical part, and the motor-control part is further configured to control operation of the driving mechanism to terminate a rearward relative movement of the pin-gripping part when the pulling force exceeds the threshold, and to move forward the pin-gripping part gripping the shaft part with the cylindrical part swaged thereto, relative to the fastener-abutment part.

2. A fastening tool configured to fasten a workpiece via a fastener, the fastener having a pin and a cylindrical part, the fastening tool comprising:

a fastener-abutment part configured to abut on the cylindrical part;

a pin-gripping part disposed to be movable along a driving axis relative to the fastener-abutment part and configured to grip a portion of the pin, the driving axis extending in a front-rear direction of the fastening tool;

a motor;

a driving mechanism configured to be driven by power of the motor to move the pin-gripping part rearward along the driving axis relative to the fastener-abutment part, thereby fastening the workpiece via the fastener;

an input-accepting part configured to accept setting information for a control condition of the motor, the setting information being inputted via an operation part configured to be externally operated by a user; and a motor-control part configured to control operation of the driving mechanism by controlling driving of the motor according to the control condition based on the setting information accepted by the input-accepting by the input-accepting part, wherein the fastening tool is configured to use, as the fastener, a tear-off type fastener, in which the pin is inserted through the cylindrical part, the pin includes a shaft part having a small-diameter part for breakage, the pin-gripping part has a plurality of gripping claws configured to grip the shaft part, and is coaxially held within the fastener-abutment part so as to be movable in the front-rear direction along the driving axis relative to the fastener-abutment part, the pin-gripping part being configured such that its gripping force of gripping the shaft part changes as the gripping claws move radially relative to the driving axis along with a movement of the pin-gripping part in the front-rear direction relative to the fastener-abutment part, the input-accepting part is configured to accept, as the setting information, setting information for an initial position of the pin-gripping part in the front-rear direction, the motor-control part is configured to control operation of the driving mechanism to move the pin-gripping part rearward from the initial position relative to the fastener-abutment part so as to pull the pin gripped by the gripping claws and deform the cylindrical part abutting on the fastener-abutment part, thereby fastening the workpiece between both end portions of the cylindrical part and tearing off the shaft part at the small-diameter part, and the motor-control part is further configured to control operation of the driving mechanism to move the pin-gripping part forward relative to the fastener-abutment part after the shaft part is torn off, and return the pin-gripping part to the initial position.

3. The fastening tool as defined in claim 1, further comprising a display part configured to display the setting information accepted by the input-accepting part or the control condition based on the setting information.

4. The fastening tool as defined in claim 3, wherein the display part is further configured to display information other than the setting information and the control condition.

5. The fastening tool as defined in claim 1, further comprising the operation part.

6. The fastening tool as defined in claim 5, wherein the operation part is configured to output the setting information as a digital signal.

7. The fastening tool as defined in claim 5, wherein:

the fastening tool is configured to operate in an input-accepting mode in which the input-accepting part is capable of accepting input of the setting information, and at least one different mode from the input-accepting mode, and switching from the mode different from the input-accepting mode to the input-accepting mode is allowed in response to a specific operation different from an operation of inputting the setting information into the operation part.

8. The fastening tool as defined in claim 1, further comprising:

a storage device configured to store the setting information accepted by the input-accepting part, or the control condition based on the setting information, wherein:

the motor-control part is configured to control driving of the motor according to the control condition based on the setting information stored in the storage device, or the control condition stored in the storage device.

9. The fastening tool as defined in claim 2, further comprising a display part configured to display the setting information accepted by the input-accepting part or the control condition based on the setting information.

10. The fastening tool as defined in claim 9, wherein the display part is further configured to display information other than the setting information and the control condition.

11. The fastening tool as defined in claim 2, further comprising the operation part.

12. The fastening tool as defined in claim 11, wherein the operation part is configured to output the setting information as a digital signal.

13. The fastening tool as defined in claim 11, wherein:

the fastening tool is configured to operate in an input-accepting mode in which the input-accepting part is capable of accepting input of the setting information, and at least one different mode from the input-accepting mode; and switching from the mode different from the input-accepting mode to the input-accepting mode is allowed in response to a specific operation different from an operation of inputting the setting information into the operation part.

14. The fastening tool as defined in claim 2, further comprising:

a storage device configured to store the setting information accepted by the input-accepting part, or the control condition based on the setting information, wherein:

the motor-control part is configured to control driving of the motor according to the control condition based on the setting information stored in the storage device, or the control condition stored in the storage device.

* * * * *